US011754318B2

(12) United States Patent
Hotton et al.

(10) Patent No.: US 11,754,318 B2
(45) Date of Patent: Sep. 12, 2023

(54) BAFFLES FOR THERMAL TRANSFER DEVICES

(71) Applicant: Rheem Manufacturing Company, Atlanta, GA (US)

(72) Inventors: Bruce Hotton, Seven Fields, PA (US); Amin Monfared, Oxnard, CA (US); Lee Chambers, Santa Paula, CA (US); Babak Bagheri, Oxnard, CA (US); Arash Jafari, Riverside, CA (US); Tim Shellenberger, Johns Creek, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/515,908

(22) Filed: Nov. 1, 2021

(65) Prior Publication Data

US 2022/0057110 A1 Feb. 24, 2022

Related U.S. Application Data

(63) Continuation of application No. 16/725,867, filed on Dec. 23, 2019, now Pat. No. 11,162,709.

(51) Int. Cl.

| | |
|---|---|
| ***F02B 75/00*** | (2006.01) |
| ***F24H 9/00*** | (2022.01) |
| ***F22B 37/06*** | (2006.01) |
| ***F28D 7/16*** | (2006.01) |
| *F28F 9/22* | (2006.01) |
| *F28F 9/24* | (2006.01) |

(52) U.S. Cl.
CPC ..... *F24H 9/0015* (2013.01); *F22B 37/06* (2013.01); *F28D 7/163* (2013.01); *F28F 9/24* (2013.01); *F28F 2009/226* (2013.01)

(58) Field of Classification Search
CPC ..... F28F 9/24; F28F 2009/226; F24H 9/0015; F22B 37/06; F28D 7/163
USPC ..... 122/19.1
See application file for complete search history.

(56) References Cited

U.S. PATENT DOCUMENTS

| | | | |
|---|---|---|---|
| 5,388,638 | A | 2/1995 | Gentry |
| 2010/0193167 | A1 | 8/2010 | Song et al. |
| 2014/0262172 | A1 | 9/2014 | Jubicic |
| 2015/0144308 | A1 | 5/2015 | Donovan et al. |
| 2019/0316472 | A1 | 10/2019 | Xu |

FOREIGN PATENT DOCUMENTS

DE 3636177 A1 * 6/1987

* cited by examiner

*Primary Examiner* — Davis D Hwu
(74) *Attorney, Agent, or Firm* — Eversheds Sutherland (US) LLP

(57) ABSTRACT

A baffle for a thermal transfer device can include a body having a multiple first apertures that traverse therethrough, where each first aperture has a first outer perimeter that includes a first base shape and at least one first protrusion extending from the first base shape. Each of the first apertures is configured to receive a tube. The first base shape of each first aperture has a first shape and a first size that is configured to be substantially the same as the first shape and the first size of an end of a tube.

19 Claims, 15 Drawing Sheets

BAFFLES FOR THERMAL TRANSFER DEVICES

CROSS-REFERENCE TO RELATED APPLICATIONS

This present application is a continuation of U.S. patent application Ser. No. 16/725,867, filed on 23 Dec. 2019, the entire contents and substance of which is incorporated herein by reference in its entirety as if fully set forth below.

TECHNICAL FIELD

Embodiments described herein relate generally to thermal transfer devices, and more particularly to baffles for thermal transfer devices.

BACKGROUND OF THE INVENTION

Heat exchangers, boilers, combustion chambers, water heaters, and other similar thermal transfer devices control or alter thermal properties of one or more fluids. In some cases, two tube sheets are disposed within these devices to hold one or more tubes (e.g., heat exchanger tubes, condenser tubes) in place. A fluid, typically water, flows within these thermal transfer devices around heat exchanger tubes, the ends of which are held in place by the tube sheets.

SUMMARY OF THE INVENTION

In general, in one aspect, the disclosure relates to baffle for a thermal transfer device. The baffle can include a body having multiple first apertures that traverse therethrough, wherein each of the first apertures has a first outer perimeter that includes a first base shape and at least one first protrusion extending from the first base shape. Each of the first apertures can be configured to receive a tube of a plurality of tubes. The first base shape of each of the first apertures can have a first shape and a first size that is configured to be substantially the same as the first shape and the first size of an end of a tube of the plurality of tubes.

In another aspect, the disclosure can generally relate to an assembly for a thermal transfer device. The assembly can include multiple tubes and a first tube sheet having a first tube sheet body that includes multiple first apertures traversing therethrough in a first arrangement, wherein each of the first apertures is configured to receive a first end of one of the tubes. The assembly can also include a second tube sheet having a second tube sheet body having multiple second apertures traversing therethrough in the first arrangement, where each of the second apertures is configured to receive a second end of one of the tubes. The assembly can further include a first baffle disposed between the first tube sheet and the second tube sheet, where the first baffle includes a first baffle body having multiple third apertures that traverse therethrough, where each of the third apertures has a first outer perimeter that includes a first base shape and at least one first protrusion extending from the first base shape. Each of the first apertures can receive a middle portion of the plurality of tubes. The first base shape of each of the third apertures can be substantially the same as that of the first apertures, and wherein the first base shape of each of the third apertures has a size that is substantially the same as that of the first apertures.

These and other aspects, objects, features, and embodiments will be apparent from the following description and the appended claims.

BRIEF DESCRIPTION OF THE DRAWINGS

The drawings illustrate only example embodiments of baffles for thermal transfer devices and are therefore not to be considered limiting of its scope, as baffles for thermal transfer devices may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION

Figure 1A:
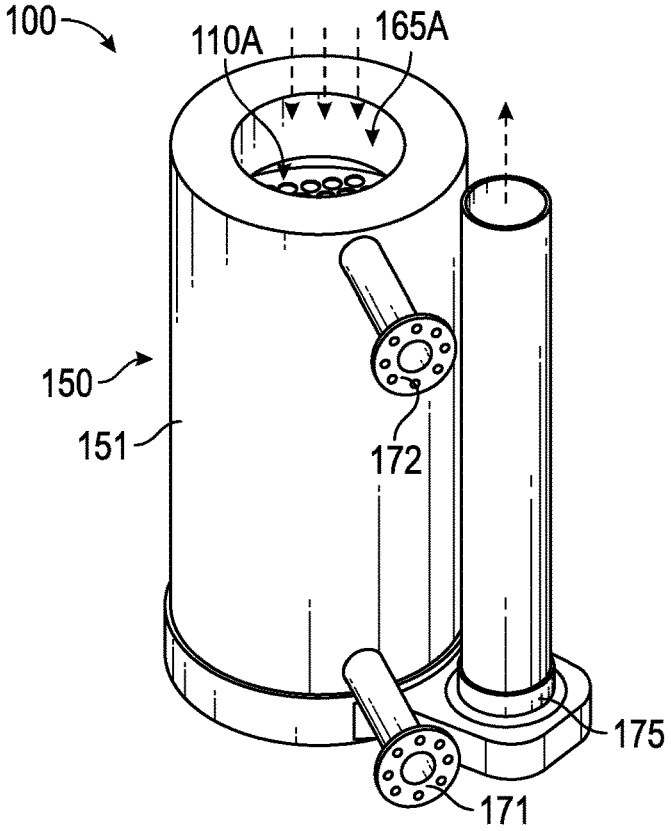
FIG. 1A (Prior Art)
FIGS. 1A and 1B show of a thermal transfer device currently used in the art.

The example embodiments discussed herein are directed to systems, methods, and devices for baffles (sometimes also called diffuser plates) for thermal transfer devices. Example embodiments can be directed to any of a number of thermal transfer devices, including but not limited to boilers, condensing boilers, heat exchangers, and water heaters. Further, one or more of any number of fluids can flow through and around the tubes (also called heat exchanger tubes or HX tubes herein) and through the example baffles disposed within these thermal transfer devices. Examples of such fluids can include, but are not limited to, water, steam, burned fuel (e.g., natural gas, propane) mixed with air, glycol, and dielectric fluids. As discussed further herein, in a boiler or water heater application, typically a heated gas flows within the HX tubes and water flows around the outside of the HX tubes and through the baffles located outside the HX tubes.

Example embodiments of baffles can be pre-fabricated or specifically generated (e.g., by shaping a malleable body)

for a particular thermal transfer device. Example embodiments can have standard or customized features (e.g., shape, size, features on the inner surface, pattern, configuration). Therefore, example embodiments described herein should not be considered limited to creation or assembly at any particular location and/or by any particular person.

The example baffles (or components thereof) described herein can be made of one or more of a number of suitable materials and/or can be configured in any of a number of ways to regulate and/or control the flow of fluid flowing around the HX tubes with a heat transfer device in such a way as to meet certain standards and/or regulations while also maintaining reliability of the heat transfer device (including components thereof, such as the HX tubes), regardless of the one or more conditions under which the example baffles can be exposed. Examples of such materials can include, but are not limited to, aluminum, stainless steel, ceramic, fiberglass, glass, plastic, and rubber. In some cases, an example baffle can be coated with one of more materials.

As discussed above, example baffles (or vessels in which example baffles are disposed) can be subject to complying with one or more of a number of standards, codes, regulations, and/or other requirements established and maintained by one or more entities. Examples of such entities can include, but are not limited to, the American Society of Mechanical Engineers (ASME), American Society of Heating, Refrigeration and Air Conditioning Engineers (ASHRAE), Underwriters' Laboratories (UL), American National Standard Institute (ANSI), the National Electric Code (NEC), and the Institute of Electrical and Electronics Engineers (IEEE). An example baffle allows a vessel of a heat transfer device (e.g., boiler, heat exchanger) to continue complying with such standards, codes, regulations, and/or other requirements. In other words, an example baffle, when disposed within the vessel of such a heat transfer device, does not compromise compliance of the vessel with any applicable codes and/or standards.

Any example baffles, or portions thereof, described herein can be made from a single piece (e.g., as from a mold, injection mold, die cast, 3-D printing process, extrusion process, stamping process, or other prototype methods). In addition, or in the alternative, an example baffles (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with example baffles. Examples of a user may include, but are not limited to, an engineer, a maintenance technician, a mechanic, an employee, an operator, a consultant, a contractor, and a manufacturer's representative. Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example baffle to become coupled, directly or indirectly, to another portion of the baffle and/or another component of a heat transfer device. A coupling feature can include, but is not limited to, a snap, a clamp, a portion of a hinge, an aperture, a recessed area, a protrusion, a slot, a spring clip, a tab, a detent, and mating threads. One portion of an example baffle can be coupled to a vessel of a heat transfer device by the direct use of one or more coupling features.

In addition, or in the alternative, a portion of an example baffle can be coupled to a vessel using one or more independent devices that interact with one or more coupling features disposed on a coupling feature of the baffle. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein. The numbering scheme for the components in the figures herein parallel the numbering scheme for the corresponding components described in another figure in that each corresponding component is a three-digit number having the identical last two digits. For any figure shown and described herein, one or more of the components may be omitted, added, repeated, and/or substituted. Accordingly, embodiments shown in a particular figure should not be considered limited to the specific arrangements of components shown in such figure.

Example embodiments of baffles for thermal transfer devices will be described more fully hereinafter with reference to the accompanying drawings, in which example embodiments of baffles for thermal transfer devices are shown. Baffles for thermal transfer devices may, however, be embodied in many different forms and should not be construed as limited to the example embodiments set forth herein. Rather, these example embodiments are provided so that this disclosure will be thorough and complete, and will fully convey the scope of baffles for thermal transfer devices to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "lower", and "upper" are used merely to distinguish one component (or part of a component or state of a component) from another. Such terms are not meant to denote a preference or a particular orientation. Such terms are not meant to limit embodiments of baffles for thermal transfer devices. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
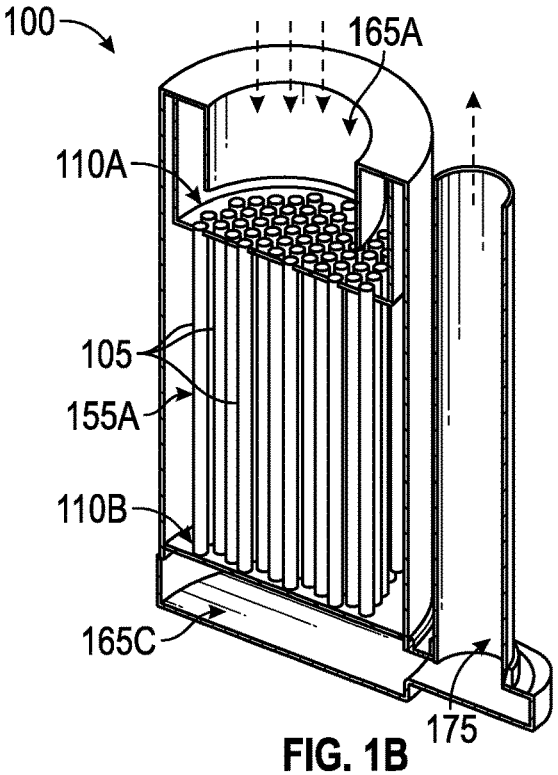
FIG. 1B (Prior Art)

FIGS. 1A and 1B show of a thermal transfer device 100 currently used in the art. Specifically, FIG. 1A shows a perspective view of the thermal transfer device 100, and FIG. 1B shows a cross-sectional perspective view of the thermal transfer device 100. Referring to FIGS. 1A and 1B, the thermal transfer device 100 includes one or more of any number of components. For example, in this case, the thermal transfer device 100 includes at least one wall 151 that forms a cavity, which in this case is divided into a top flue gas portion 165A, a main fluid portion 155A, and a bottom flue gas portion 165C (also called a flue gas collection chamber 165C). The flue gas collection chamber 165C provides a collection of flue gas for an exhaust vent 175. The thermal transfer device 100 in this case includes two tube sheets 110 (top tube sheet 110A and bottom tube sheet 110B). Tube sheet 110A separates the top flue gas portion 165C from the main fluid portion 155A, and tube sheet 110B separates the main fluid portion 155A from the flue gas collection chamber 165C. Tube sheet 110A and tube sheet 110B hold a number of HX tubes 105.

The thermal transfer device 100 uses a mixture of a combusted fuel (e.g., natural gas, propane, coal) and air to transfer heat to a fluid (e.g., water), and the heated fluid (e.g., water, steam) can be used for some other process or purpose. The mixture of the combusted fuel and air can be called flue gas. In some cases, the fuel can be premixed with some other component, such as air. For example, the fuel/air mixture can be introduced into the top flue gas portion 165A at the top of the thermal transfer device 100, as shown at the top of FIGS. 1A and 1B. Once inside the top flue gas portion 165A, there can be some heat source (e.g., a burner, an ignitor) that raises the temperature of the fuel/air mixture, resulting in combustion and burning of the fuel/air mixture.

From there, the resulting hot gases (byproducts of the combustion of the fuel/air mixture) can be directed into the various HX tubes 105 and travel down those HX tubes 105 to the flue gas collection chamber 165C. The HX tubes 105 are made of one or more of a number of thermally conductive materials (e.g., aluminum, stainless steel). In this way, the heat from the hot gases transfers to the HX tubes 105 as the hot fuel/air mixture travels toward the flue gas collection chamber 165C. Once reaching the flue gas collection chamber 165C, the hot gases then continue on to the exhaust vent 175 and leaves the thermal transfer device 100. The water vapor in the hot gases can either be in the vapor phase (non-condensing mode) or in the liquid phase (condensing mode), depending on the design of the thermal transfer device 100.

At the same time, another fluid (e.g., water) is brought into the bottom part of the main fluid portion 155A of the thermal transfer device 100 through the inlet 171. Once inside the main fluid portion 155A, the fluid comes into contact with the outer surfaces of the HX tubes 105. As discussed above, since the HX tubes 105 are made of a thermally conductive material, when the hot gases (from the combustion process) travel down the HX tubes 105, some of the heat from the fuel is transferred to the walls of the HX tubes 105. Consequently, as the fluid comes into contact with the outer surface of the thermally-conductive walls of the HX tubes 105 within the main fluid portion 155A, some of the heat captured by the walls of the tubes HX 105 from the heated fuel is further transferred to the fluid in the main fluid portion 155A. The heated fluid is drawn up toward the top of the main fluid portion 155A of the thermal transfer device 100. Once reaching the top of the main fluid portion 155A, the heated fluid is then drawn out of the thermal transfer device 100 through the outlet 172. The heated fluid can then be used for one or more other processes, such as space heating and hot water for use in a shower, a clothes washing machine, and/or a dishwashing machine.

The HX tubes 105 are held in place within the main fluid portion 155A of the thermal transfer device 100 by tube sheets 110. Specifically, one tube sheet 110A is disposed toward the top end of the main fluid portion 155A and secures one end of the HX tubes 105, while another tube sheet 110B is disposed toward the bottom end of the main fluid portion 155A and secures the opposite end of the HX tubes 105. The tube sheets 110 can be coupled to an interior surface (e.g., disposed in a recess of an inner surface of the wall 151) of the thermal transfer device 100.

As discussed above, the tube sheets 110 also set the bounds of the main fluid portion 155A in which the fluid flows. Specifically, the holes in the tube sheets 110 are configured to substantially perfectly accommodate the ends of the HX tubes 105, and the outer perimeter of the tube sheets 110 is configured to abut against the inner surface of the wall 151. In this way, none of the combusted fuel/air mixture intermingles with the fluid that is being heated at any point within the thermal transfer device 100. In other words, the fluid does not enter the top flue gas portion 165A and the bottom flue gas portion 165C, and the fuel/air mixture does not enter the main fluid portion 155A.

Figure 2A:
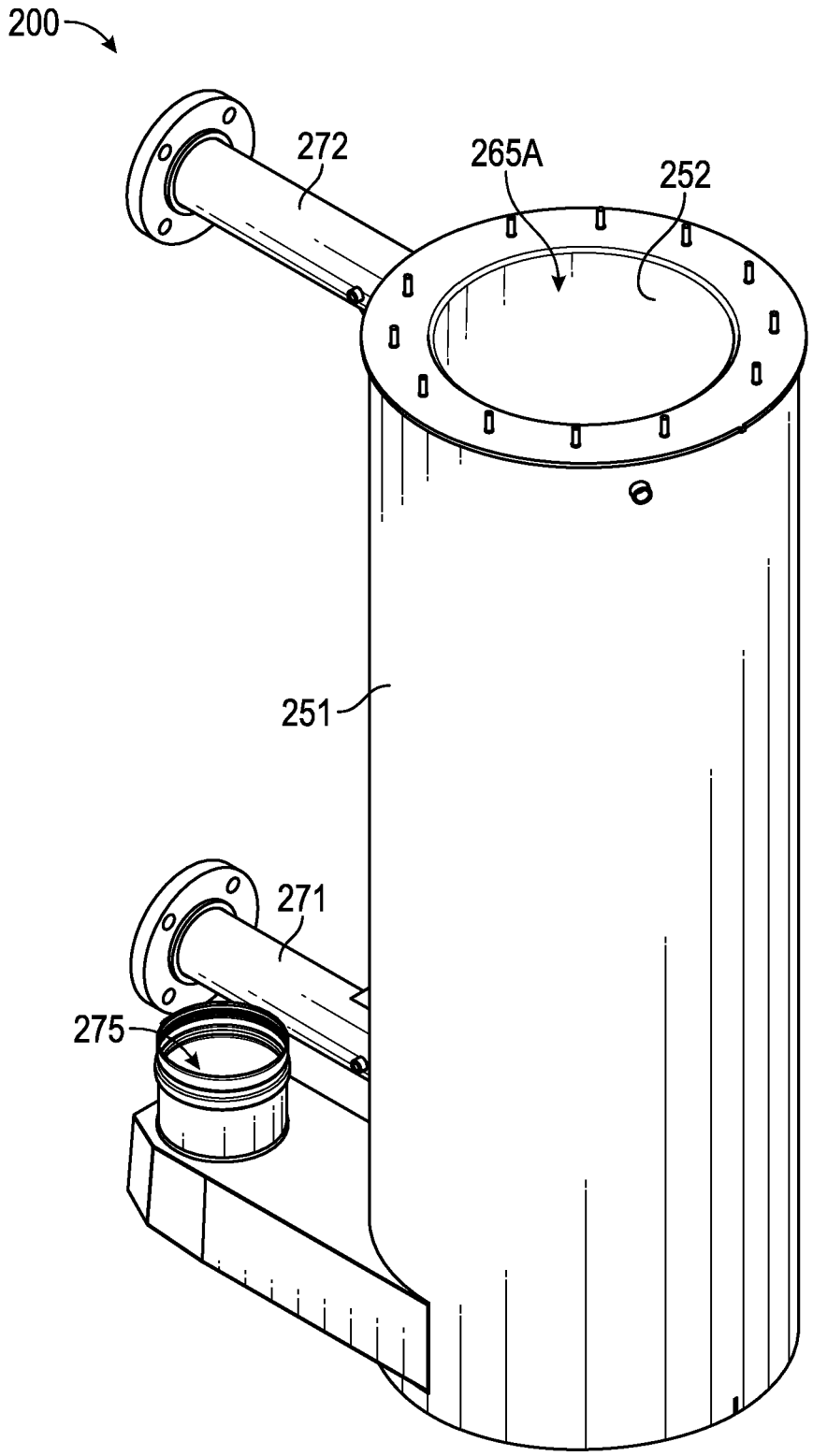
FIGS. 2A through 2D show various views of a thermal transfer device in accordance with certain example embodiments.
Figure 2B:
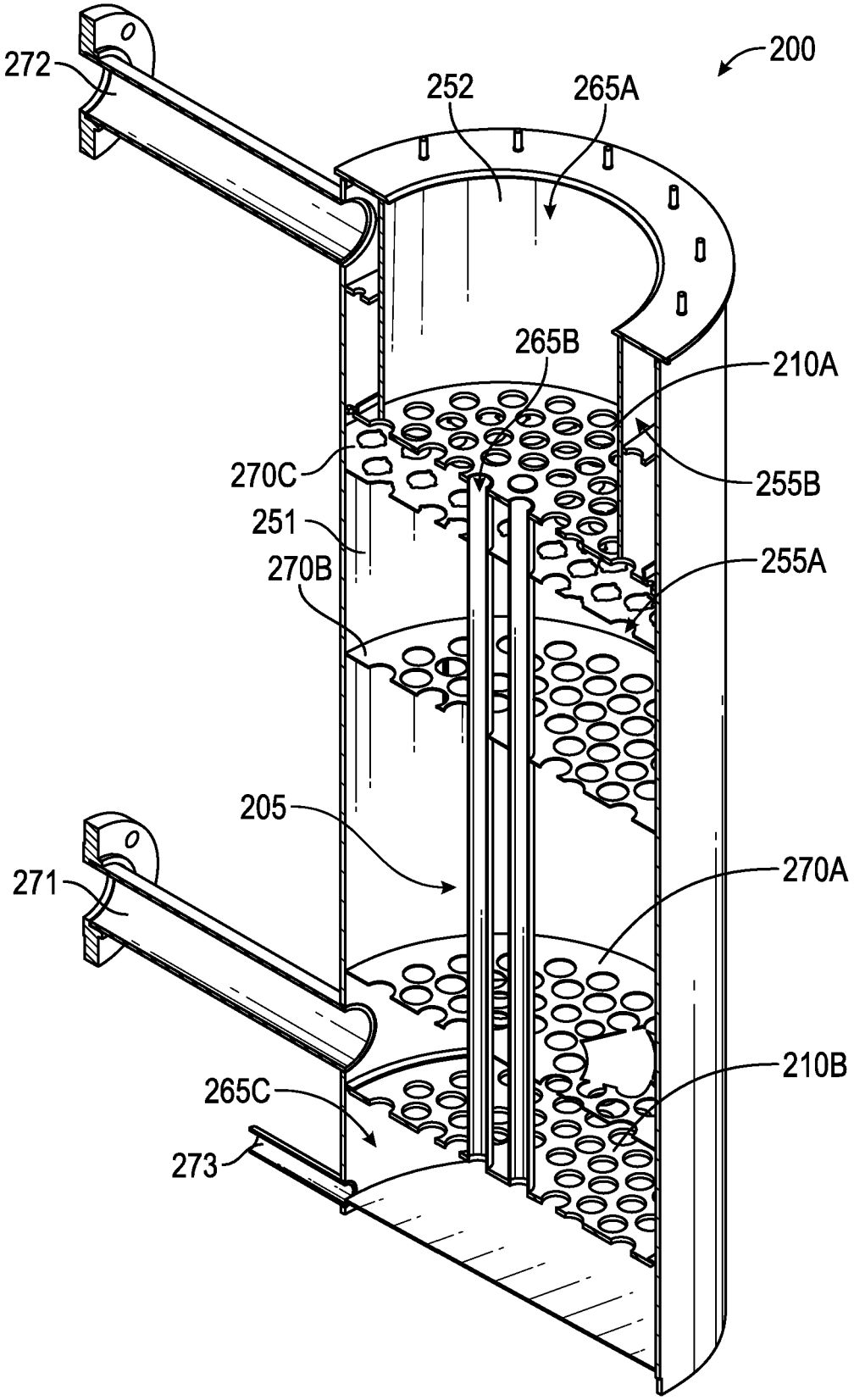
Figure 2C:
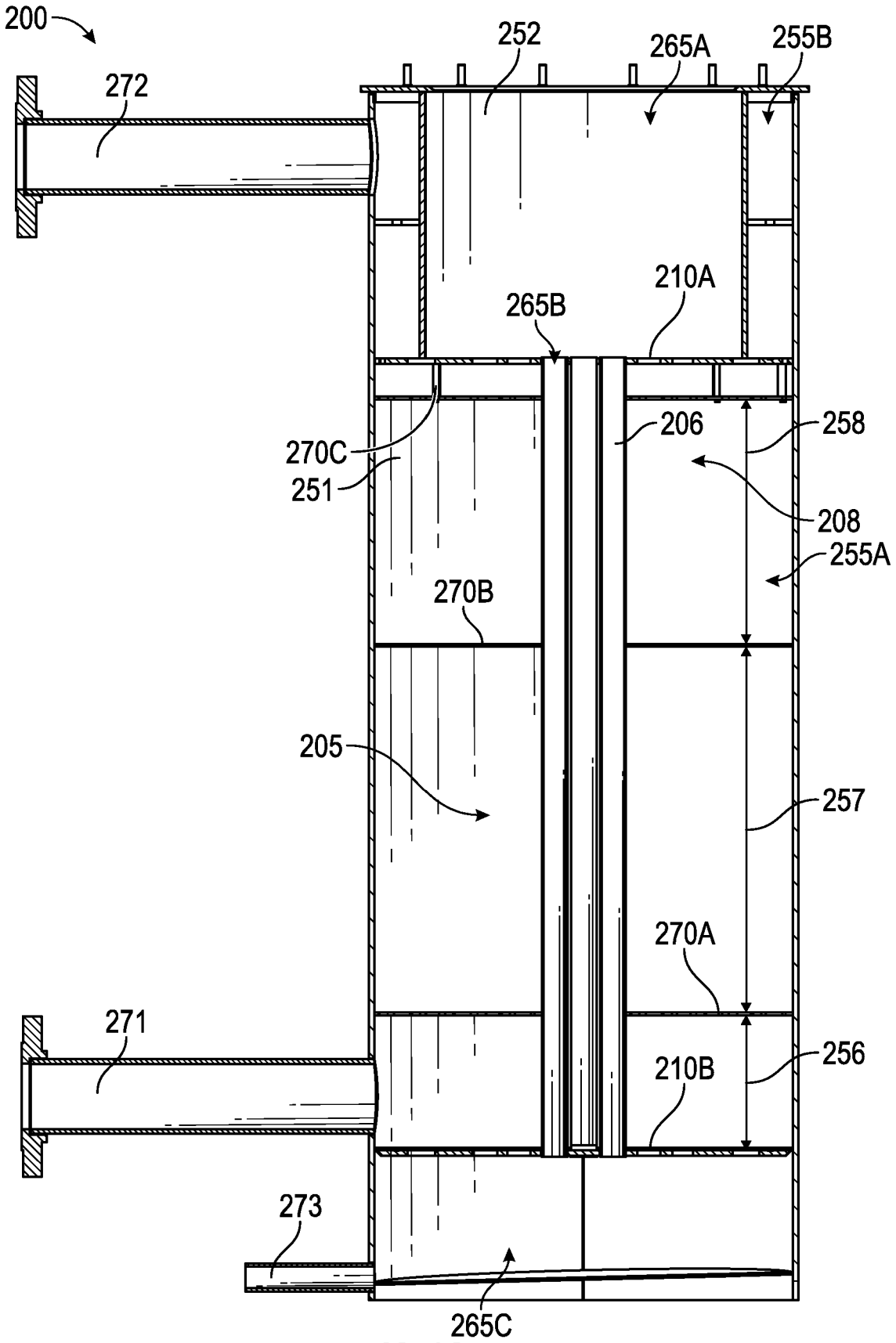
Figure 2D:
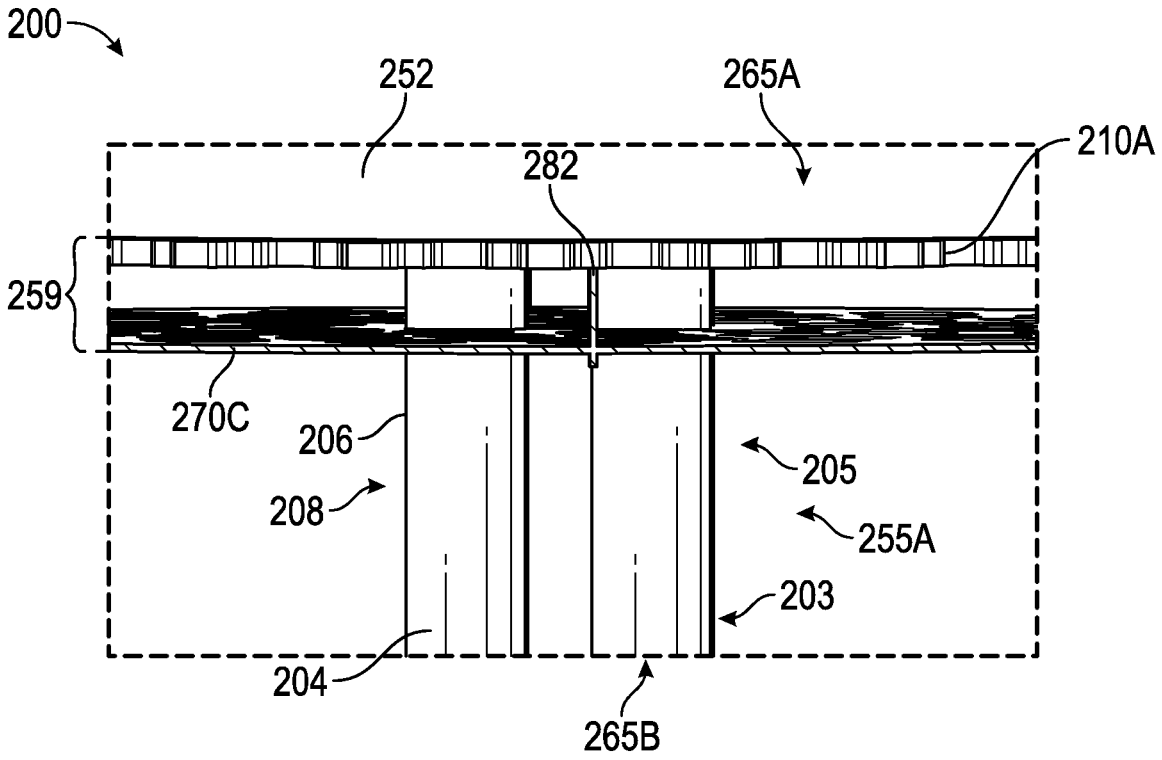

FIGS. 2A through 2D show various views of a thermal transfer device 200 in accordance with certain example embodiments. Specifically, FIG. 2A shows a front-side-top perspective view of the thermal transfer device 200. FIG. 2B shows a cross-sectional front-side-top perspective view of the thermal transfer device 200. FIG. 2C shows a cross-sectional side view of the thermal transfer device 200. FIG. 2D shows a detailed cross-sectional side view of the thermal transfer device 200.

Referring to FIGS. 1A through 2D, the thermal transfer device 200 has some similarities to the thermal transfer device 100 of FIGS. 1A and 1B. For example, the thermal transfer device 200 of FIGS. 2A through 2D includes at least one wall 251, inside of which are one or more portions of one or more cavities. Toward the bottom of the thermal transfer device 200 is a flue gas collection chamber 265C, (also called a bottom flue gas portion 265C herein) above which is located the HX tubes 205 and the main fluid portion 255A, above which is located the top flue gas portion 265A (also called a combustion chamber 265A). A tube sheet 210A separates the top flue gas portion 265A from the main fluid portion 255A, and another tube sheet 210B separates the bottom flue gas portion 265C from the main fluid portion 255A.

There are a number of HX tubes 205 disposed within the main fluid portion 255A and held in place by tube sheet 210A and tube sheet 210B. An exhaust vent 275 is connected to the bottom flue gas portion 265C by a pipe 273. There is also an inlet 271 that feeds fluid into the main fluid portion 255A of the thermal transfer device 200, and there is an outlet 272 that removes heated fluid from the thermal transfer device 200. All of these various components of the thermal transfer device 200 of FIGS. 2A through 2D can be substantially the same as the corresponding components of the thermal transfer device 100 of FIGS. 1A and 1B, except as described below.

Figure 4:
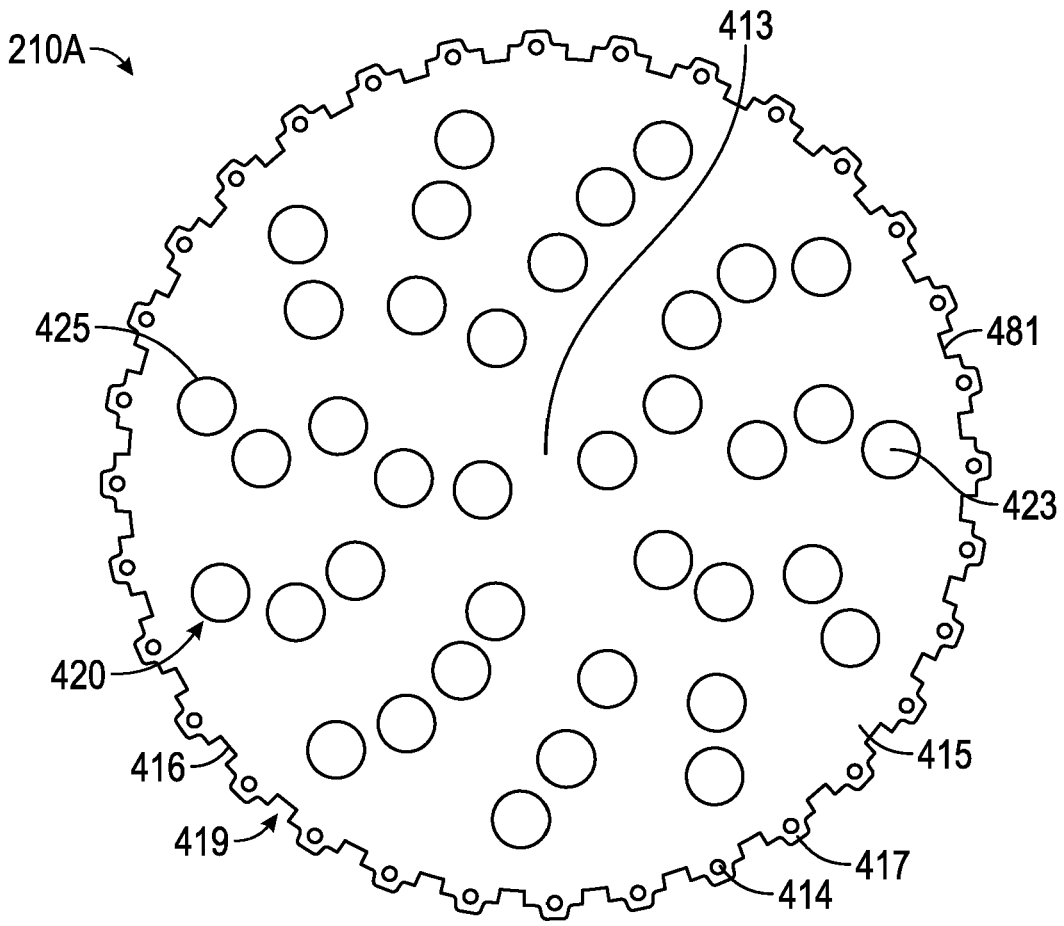
FIGS. 4 and 5 show top views of the tube sheets of FIGS. 2A through 2D.
Figure 5:
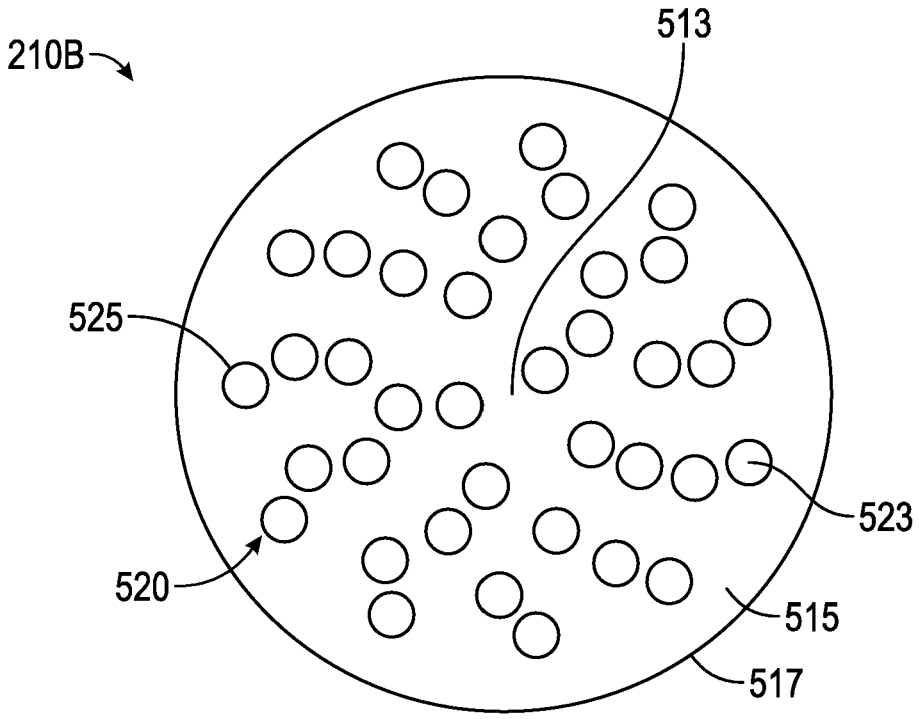

Tube sheet 210A is disposed near the top end of the HX tubes 205, and bottom tube sheet 210B is disposed near the bottom end of the HX tubes 205. In some cases, the top tube sheet 210A and the bottom tube sheet 210B are substantially identical to each other. Alternatively, as in this case, the top tube sheet 210A and the bottom tube sheet 210B are configured differently with respect to each other. A detailed view of tube sheet 210A is shown in FIG. 4 below, and a detailed view of tube sheet 210B is shown in FIG. 5 below.

The thermal transfer device 200 of FIGS. 2A through 2D also includes a number (in this case, three) of baffles 270 (also sometimes called diffuser plates 270) disposed within the main fluid portion 255A between tube sheet 210A and tube sheet 210B. Each baffle 270 can serve one or more purposes. For example, a role of a baffle 270 can be to redirect the flow of fluid within the main fluid portion 255A. As another example, a baffle 270 can be used to make the flow of fluid within the main fluid portion 255A more uniform around the HX tubes 205. As yet another example, from a structural point of view, a baffle 270 can be used, in conjunction with tube sheets 210, to maintain the position of the HX tubes 205 within the main fluid portion 255A.

Baffle 270A is disposed toward the bottom of the main fluid portion 255A just above inlet 271 and a distance 256 above tube sheet 210B. A detailed view of baffle 270A is shown below with respect to FIG. 6 below. Baffle 270B is disposed toward the middle of the main fluid portion 255A a distance 257 above baffle 270A. A detailed view of baffle 270B is shown below with respect to FIG. 7 below. Baffle 270C is disposed toward the top of the main fluid portion 255A a distance 258 above baffle 270B and a distance 259 below tube sheet 210A. A detailed view of baffle 270C is shown below with respect to FIG. 8 below.

The baffles 270 can be located within the main fluid portion 255A in one or more of a number of ways. For example, a baffle 270 can be coupled to an inner surface of the wall 251 using one or more coupling features (e.g., welding, slots, compression fittings, fastening devices (e.g., bolt, rivet)). For instance, a baffle 270 can be disposed within a slot in the inner surface of the wall 251. As another example, one or more brackets, standoffs, and/or other independent components can be used to secure one or more baffles 270.

Any of these distances separating one baffle 270 from another baffle 270 and/or from a tube sheet 210 can be adjusted to increase the benefits (e.g., more effective temperature distribution to eliminate "hot spots", more efficient flow of the fluid) of using example baffles 270 in the thermal transfer device 200. Any of the baffles 270 described herein can be planar (as shown in FIGS. 2A through 2D). Alternatively, the body (described below) of a baffle 270 can formed over three-dimensions (e.g., curved, helically-shaped). The thickness of the body of a baffle 270 can be uniform throughout the entirety of the body. Alternatively, the thickness of the body of a baffle 270 can vary. Also, as shown in FIGS. 2A through 2D, a baffle 270 can be oriented in parallel with the tube sheets 210 and perpendicular with the wall 251 of the thermal transfer device. Alternatively, a baffle 270 can be oriented at some other angle relative to the wall 251 within the main fluid portion 255A.

The thermal transfer device 200 shows some, but not all, of the HX tubes 205. In this case, the HX tubes 205 can all be configured identically with respect to each other. Alternatively, one or more HX tubes 205 can be configured differently than one or more of the other HX tubes 205. In this example, each HX tube 205 has a fundamentally tubular and featureless outer surface 206, as shown at each end 208. The middle portion 203 of each HX tube 205 is disposed between the ends 208 and in this case also has a featureless outer surface 204. There is a continuous path inside the cavity 265B of each HX tube 205 along the entire length of the HX tube 205.

Figure 3A:
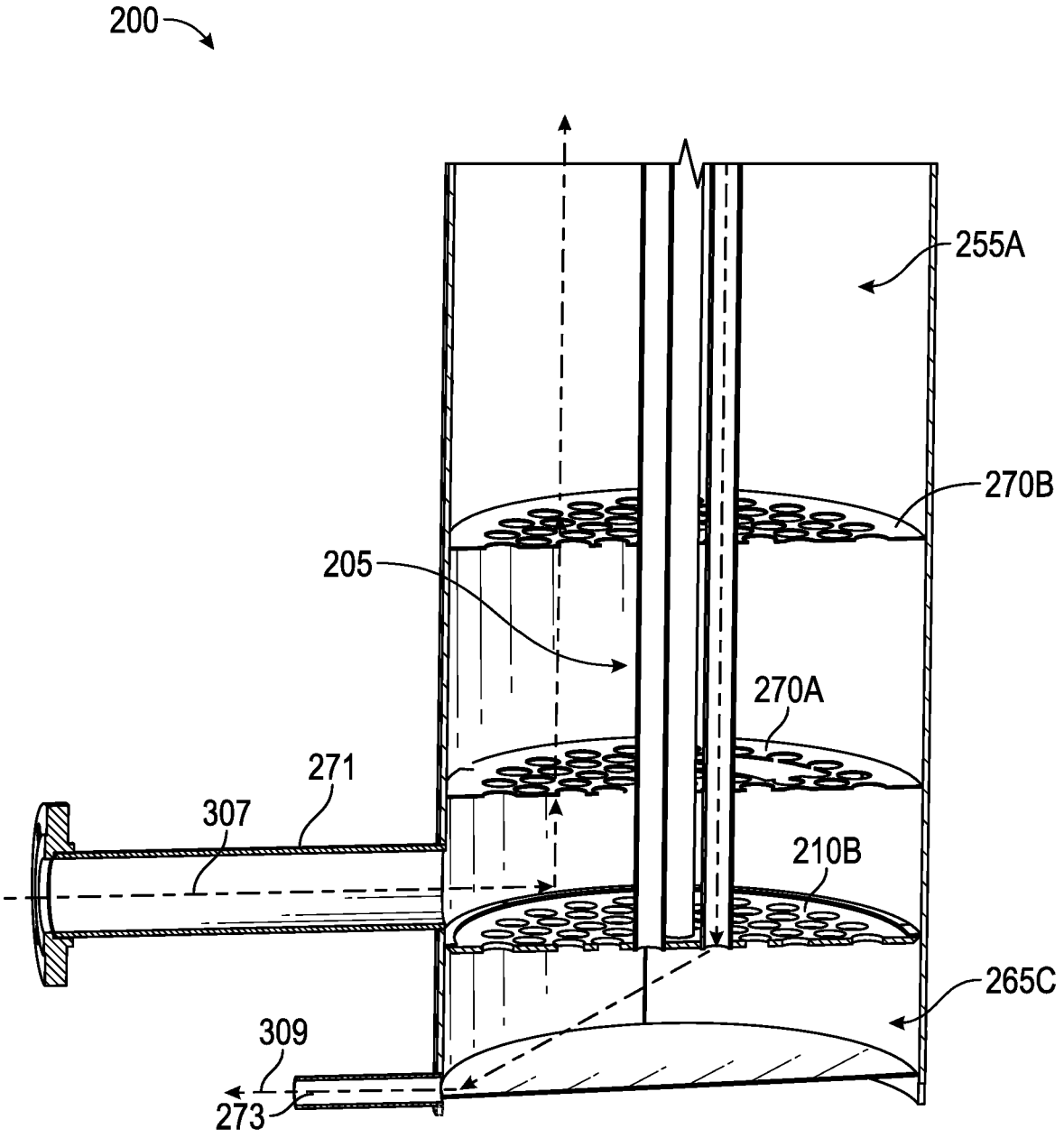
FIGS. 3A and 3B show the flow of fluid and a combusted fuel/air mixture through the thermal transfer device of FIGS. 2A through 2D in accordance with certain example embodiments.
Figure 3B:
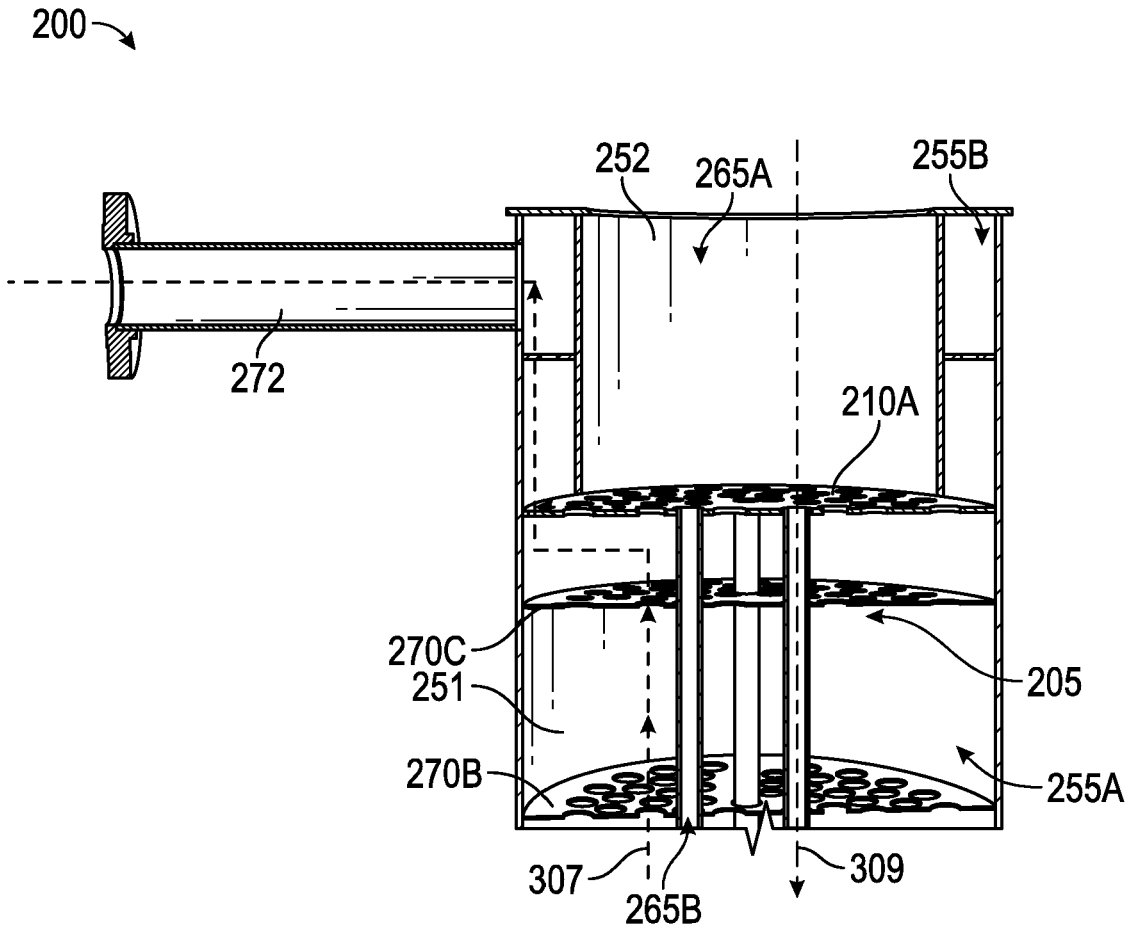

Above tube sheet 210A are the top flue gas portion 265A and the fluid collection portion 255B, which are separated from each other by a wall 252 and the tube sheet 210A. Fluid continuity is formed between the fluid collection portion 255B and the main fluid portion 255A by a series of recessed features along the outer perimeter of tube sheet 210A, an example of which is shown in more detail in FIG. 4 below. FIGS. 3A and 3B, which describe the flow of the fluid and the flue gas (the combusted fuel/air mixture) through the thermal transfer device 200, provide more details as to the configuration and functionality of these spaces (e.g., fluid collection portion 255B) within the thermal transfer device 200.

FIGS. 3A and 3B show the flow of fluid 307 and a combusted fuel/air mixture 309 through the thermal transfer device 200 of FIGS. 2A through 2D in accordance with certain example embodiments. Specifically, FIG. 3A shows a cross-sectional side view of the lower half of the thermal transfer device 200. FIG. 3B shows a cross-sectional side view of the upper half of the thermal transfer device 200. Referring to FIGS. 1A through 3B, the combusted fuel/air mixture 309 is introduced to the thermal transfer device 200 at the top flue gas portion 265A. While not shown in FIGS. 1A through 3B, there can be one or more components (e.g., piping, a burner, a blower) that are used to combust the fuel, mix the air, and deliver the combusted fuel/air mixture 309 to the top flue gas portion 265A.

Once inside the top flue gas portion 265A, because of the barrier formed by the tube sheet 210A against the wall 252 and top end of the HX tubes 205, the combusted fuel/air mixture 309 is directed into the cavity 265B of each of the HX tubes 205. As discussed above, as the combusted fuel/air mixture 309 moves down the cavity 265B of the HX tubes 205, heat energy from the combusted fuel/air mixture 309 is transferred to the thermally-conductive wall of the HX tubes 205, thereby heating the thermally-conductive wall of the HX tubes 205.

Afterwards, the combusted fuel/air mixture 309 reaches the bottom of the HX tubes 205, thereby entering the bottom flue gas portion 265C of the thermal transfer device 200. The bottom flue gas portion 265C than continues from the bottom flue gas portion 265C through the pipe 271 to the exhaust vent 275. After the exhaust vent 275, the bottom flue gas portion 265C leaves the thermal transfer device 200, whether to be vented to the atmosphere, used for another process, further processed by another device, or otherwise utilized or disposed. This flow of the combusted fuel/air mixture 309 is continuous, at least for a period of time (e.g., ten minutes, an hour, three days), depending on factors such as the configuration of the thermal transfer device 200 and the demand for the fluid 307 that is heated by the thermal transfer device 200.

The fluid 307 flows in the opposite direction (bottom to top) within the thermal transfer device 200 relative to the combusted fuel/air mixture 309 in this case. Specifically, the fluid 307 enters the inlet 273 and subsequently proceeds to the bottom of the main fluid portion 255A. Once in the main fluid portion 255A, the fluid 307 receives heat held by the thermally-conductive walls of the HX tubes 205 disposed throughout the main fluid portion 255A. Over time, the temperature of the fluid 307 increases as the fluid 307 remains in the main fluid portion 255A.

At some point (e.g., seconds later, hours later, days later) in time after entering the main fluid portion 255A, the fluid 307 is drawn out of the main fluid portion 255A, past the features (e.g., recesses) along the outer perimeter of tube sheet 210A, and into the fluid collection portion 255B. As the fluid 307 is drawn out of the main fluid portion 255A, the fluid passes through each of the baffles 270, starting with baffle 270A, followed by baffle 270B, and ending with baffle 270C. Once the fluid 307 is inside the fluid collection portion 255B, the fluid 307 is drawn out of the thermal transfer device 200 through outlet 272.

FIG. 4 shows a top view of a tube sheet 210A from the thermal transfer device 200 of FIGS. 2A through 3B. Referring to FIGS. 1A-4, tube sheet 210A of FIG. 4 has a body 415 through which a number of apertures 420 traverse. The body 415 has an outer perimeter 417 that is formed in part by, in this case, a number of equidistantly spaced features 419. Without the features 419, the outer perimeter 417 of the tube sheet 210A would form a circle having a shape and size the substantially matches the shape and size of the inner surface of the wall 251 toward the top of the thermal transfer device 200. In alternative cases, the outer perimeter 417 of the body 415 of the tube sheet 210A can have any of a number of other shapes, including but not limited to a square, an oval, a triangle, a hexagon, a random shape, and an octagon.

The features 419 in this case are step-wise recesses 416 through which fluid (e.g., fluid 307) flows from the main fluid portion 255A to the fluid collection portion 255B. There can also be a small aperture 414 that traverses the body 415 proximate to the outer perimeter 417 inbetween adjacent recesses 416. Each aperture 414 can be used as a coupling feature (e.g., to receive a fastening device (e.g., a rivet, a bolt)) or as another path for fluid (e.g., fluid 307) to flow from the main fluid portion 255A to the fluid collection portion 255B.

The features 419 shown in FIG. 4 are only an example as to the number, size, shape, relative spacing, and configuration of such features 419. While all of the features 419 of FIG. 4 are substantially identical to each other and are spaced equidistantly from each other, in alternative embodiments, one feature 419 can have a different configuration relative to one or more other features 419 of the tube sheet 210A. Also, the number of features 419 and/or spacing between adjacent features 419 can vary.

The tube sheet 210A can have multiple apertures 420 that traverse the body 415. In such a case, as shown in FIG. 4, all of the apertures 420 can have substantially the same size and shape as each other. Alternatively, the size and shape of one aperture 420 can have a different size and/or shape compared to one or more other apertures 420. Such shapes can include, but are not limited to, a circle (as shown in FIG. 4), a square, an oval, and a triangle. Each of the apertures 420 is configured to receive the top end of a HX tube 205.

The body 415 can have a center 413. The apertures 420 that traverse the body 415 of the tube sheet 210A are disposed in an organized manner around the center 413 of the body 415 of the tube sheet 210A. For example, in this case, the apertures 420 are organized in five concentric circles around the center 413. The apertures 420 can be arranged in any of a number of other patterns (e.g., rows and columns, randomly) in alternative embodiments. Each aperture 420 has an outer perimeter 425 (which is part of the body 415) that forms, when viewed from above, a circle having a radius and a center 423.

Due to the functions served by the tube sheet 210A, namely to hold the top end of the HX tubes 205 in place while maintaining a physical barrier between the main fluid portion 255A and the top flue gas portion 265A (thereby preventing the fluid (e.g., fluid 307) from entering the top flue gas portion 265A and preventing the combusted fuel/air mixture (e.g., combusted fuel/air mixture 309) from entering the main fluid portion 255A), the shape and size of each aperture 420 is designed to be substantially the same as the shape and size of the outer surface of the HX tube 205 disposed therein. An example of this arrangement of a HX tube 205 disposed in an aperture 420 of the tube sheet 210A is shown below with respect to FIG. 9.

FIG. 5 shows a top view of a tube sheet 210B from the thermal transfer device 200 of FIGS. 2A through 3B. Referring to FIGS. 1A through 5, tube sheet 210B of FIG. 5 has a body 515 through which a number of apertures 520 traverse. The body 515 has an outer perimeter 517 that forms, in this case, a circle. Unlike the tube sheet 210A of FIG. 4, there are no features incorporated into the outer perimeter 517 of tube sheet 210B of FIG. 5. The outer perimeter 517 of the tube sheet 210B has a shape and size the substantially matches the shape and size of the inner surface of the wall 251 toward the bottom of the thermal transfer device 200. In alternative cases, the outer perimeter 517 of the body 515 of the tube sheet 210B can have any of a number of other shapes, including but not limited to a square, an oval, a triangle, a hexagon, a random shape, and an octagon.

The tube sheet 210B can have multiple apertures 520 that traverse the body 515. In such a case, as shown in FIG. 5, all of the apertures 520 can have substantially the same size and shape as each other. Alternatively, the size and shape of one aperture 520 can have a different size and/or shape compared to one or more other apertures 520. Such shapes can include, but are not limited to, a circle (as shown in FIG. 5), a square, an oval, and a triangle. Each of the apertures 520 is configured to receive the bottom end of a HX tube 205.

The body 515 can have a center 513. The apertures 520 that traverse the body 515 of the tube sheet 210B are disposed in an organized manner around the center 513 of the body 515 of the tube sheet 210B. For example, in this case, the apertures 520 are organized in five concentric circles around the center 513, matching the configuration of the apertures 420 of the tube sheet 210A of FIG. 4. The apertures 520 can be arranged in any of a number of other patterns (e.g., rows and columns, randomly) in alternative embodiments. Each aperture 520 has an outer perimeter 525 (which is part of the body 515) that forms, when viewed from above, a circle having a radius and a center 523.

Figure 9:
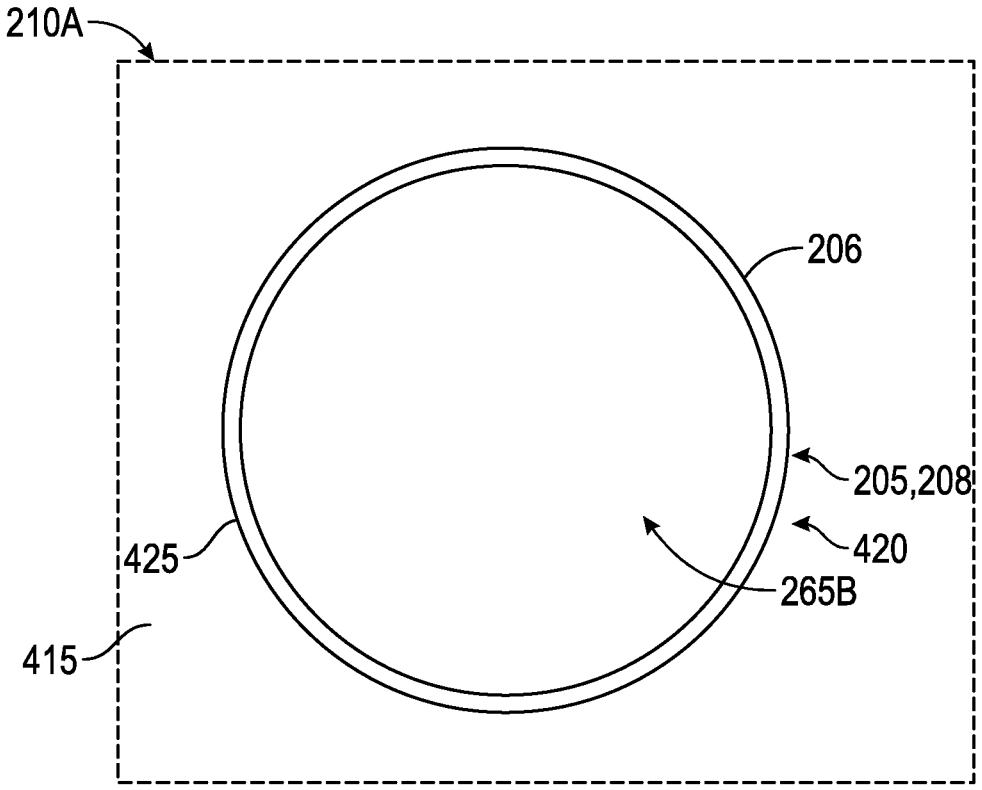
FIG. 9 shows a detailed cross-sectional top view of the interaction between a HX tube and a tube sheet of FIGS. 2A through 2D.

Due to the functions served by the tube sheet 210B, namely to hold the bottom end of the HX tubes 205 in place while maintaining a physical barrier between the main fluid portion 255A and the bottom flue gas portion 265C (thereby preventing the fluid (e.g., fluid 307) from entering the bottom flue gas portion 265C and preventing the combusted fuel/air mixture (e.g., combusted fuel/air mixture 309) from entering the main fluid portion 255A), the shape and size of each aperture 520 is designed to be substantially the same as the shape and size of the outer surface of the HX tube 205 disposed therein. The example arrangement of a HX tube 205 disposed in an aperture 420 of the tube sheet 210A, as shown in FIG. 9 below, also applies to the arrangement of a HX tube 205 disposed in an aperture 520 of the tube sheet 210B.

Figure 6:
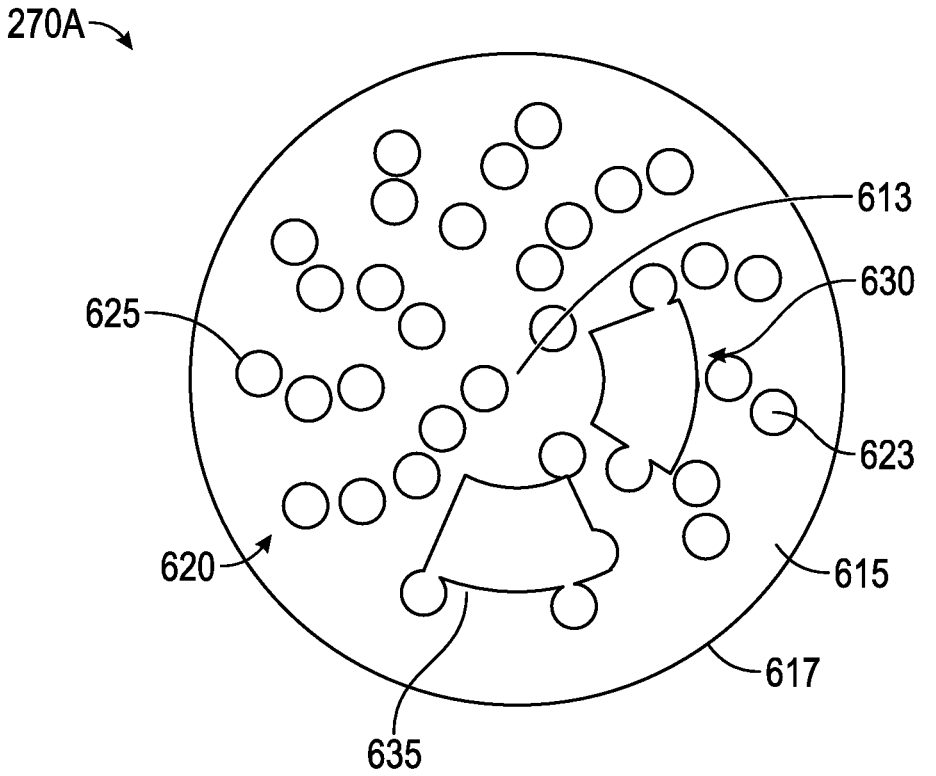
FIGS. 6 through 8 show baffles of FIGS. 2A through 2D in accordance with certain example embodiments.
Figure 7:
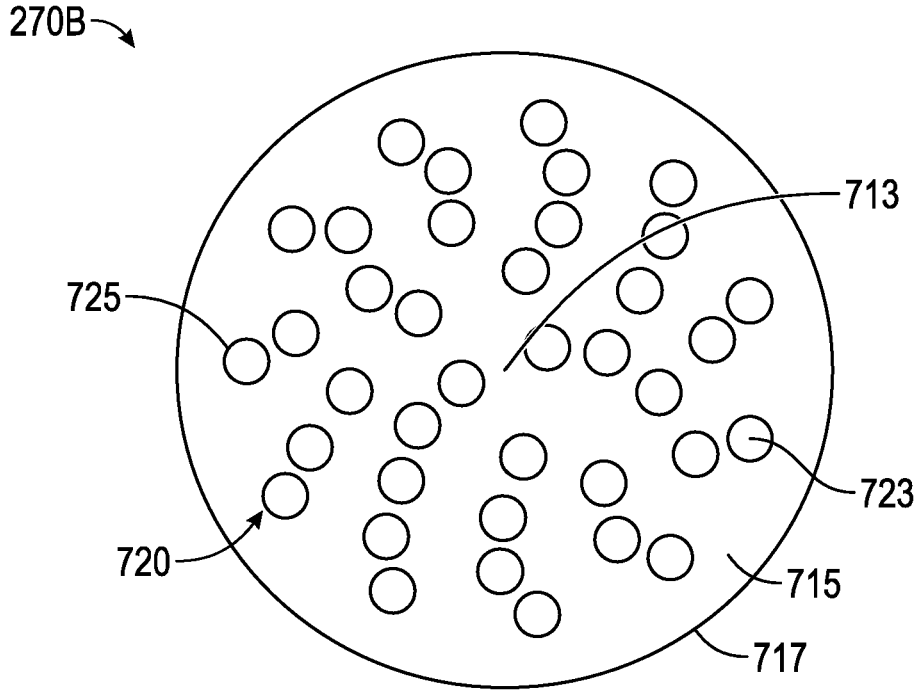
Figure 8:
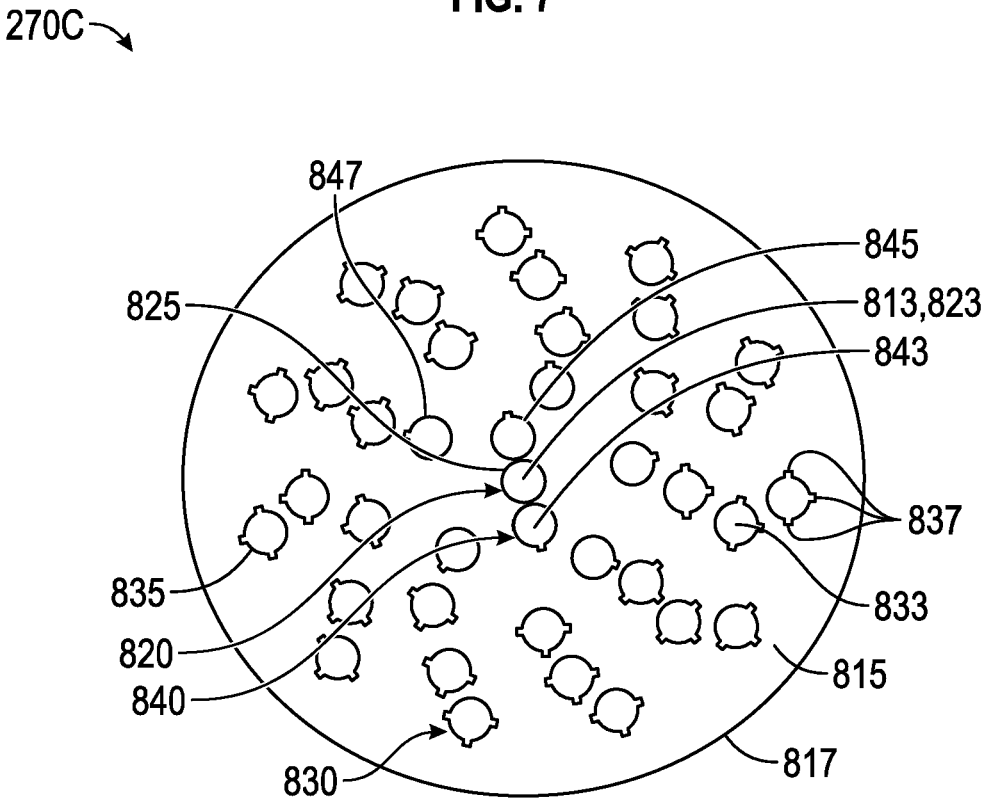

FIGS. 6 through 8 show baffles 270 of FIGS. 2A through 2D in accordance with certain example embodiments. Specifically, FIG. 6 shows a top view of baffle 270A from the thermal transfer device 200 of FIGS. 2A through 3B. Specifically, FIG. 7 shows a top view of baffle 270B from the thermal transfer device 200 of FIGS. 2A through 3B. Specifically, FIG. 8 shows a top view of baffle 270C from the thermal transfer device 200 of FIGS. 2A through 3B.

Referring to FIGS. 1A through 8, the baffle 270A of FIG. 6 is substantially the same as the tube sheet 210B of FIG. 5, except as described below. For example, the baffle 270A of FIG. 6 has a body 615 through which a number of apertures 620 traverse. The body 615 has an outer perimeter 617 that forms, in this case, a circle. The outer perimeter 617 of the baffle 270A has a shape and size the substantially matches the shape and size of the inner surface of the wall 251 toward the bottom of the thermal transfer device 200. In alternative cases, the outer perimeter 617 of the body 615 of the baffle 270A can have any of a number of other shapes, including but not limited to a square, an oval, a triangle, a hexagon, a random shape, and an octagon.

The baffle 270A can have multiple apertures 620 that traverse the body 615. In such a case, as shown in FIG. 6, all of the apertures 620 can have substantially the same size and shape as each other. Alternatively, the size and shape of one aperture 620 can have a different size and/or shape compared to one or more other apertures 620. Such shapes can include, but are not limited to, a circle (as shown in FIG. 6), a square, an oval, and a triangle. Each of the apertures 620 is configured to receive a portion (e.g., toward the bottom end, toward the middle of a HX tube 205.

The body 615 can have a center 613. The apertures 620 that traverse the body 615 of the baffle 270A are disposed in an organized manner around the center 613 of the body 615 of the baffle 270A. For example, in this case, the apertures 620 are organized in five concentric circles around the center 613, matching the configuration of the apertures 420 of the tube sheet 210A of FIG. 4 and the apertures 520 of the tube sheet 210B of FIG. 5. The apertures 620 can be arranged in any of a number of other patterns (e.g., rows and columns, randomly) in alternative embodiments. Each aperture 620 has an outer perimeter 625 (which is part of the body 615) that forms, when viewed from above, a circle having a radius and a center 623. Since the HX tubes 205 are linear along their length, the apertures 620 of baffle 270A (or where the apertures 620 would be in the absence of apertures 630) are vertically aligned with the apertures 520 of tube sheet 210B when baffle 270A is positioned within the main fluid portion 255A.

Due to the functions served by the baffle 270A, namely to help support at least some of the HX tubes 205 while allowing a controlled amount of fluid (e.g., fluid 307) to pass from one side of the body 615 to the other within the main fluid portion 255A, the shape and size of each aperture 620 is designed to be substantially the same as the shape and size of the tubular outer surface 206 each end 208 of the HX tube 205, even though the middle portion 203 of the HX tube 205 is disposed therein. The example arrangement of a HX tube 205 disposed in an aperture 620 of the baffle 270A can be applied to the example shown in FIG. 10 below, which applies to the arrangement of a HX tube 205 disposed in two apertures 720 of the baffle 270B.

As for the apertures 630 of the baffle 270A, HX tubes 205 that are disposed therein have an increased amount of fluid (e.g., fluid 307) flowing around their outer surface because the outer perimeter 635 of each aperture 630 either does not come into contact with the outer surface of a HX tube 205 or contacts only a portion (circumferentially) of the outer surface of a HX tube 205.

In certain example embodiments, such as what is shown in FIG. 6, one or more of the baffles 270 (in this case, baffle 270A) can have one or more additional apertures 630, of a different shape relative to apertures 620, traversing through the body 615. These one or more additional apertures 630 can be larger (as in this case) or smaller than the apertures 620. If there are multiple additional apertures 630, one additional aperture 630 can have the same and/or different characteristics (e.g., shape (e.g., square, rectangle, wedge, arc segment), size, location relative to the center 613) relative to one or more of the other additional apertures 630. In this case, there are two identical additional apertures 630 that have the shape of an arc segment with a height that is approximately equal to the diameter of two apertures 620. Rather than opposing each other, the two apertures 630 of FIG. 6 are adjacent to each other. Specifically, one aperture 630 is located in an approximate 3:00 position, while the other aperture 630 is located in an approximate 6:00 position.

One or more of the additional apertures 630 can be positioned independently of any of the apertures 620. Alternatively, as in this case, one or more of the additional apertures 630 can be superimposed with respect to one or more of the apertures 620. In such a case, when an aperture 620 partially overlaps with an aperture 630, the outer perimeter 635 of the aperture 630 is distorted (extended) at that location. These additional apertures 630 are not configured, like apertures 620, to fit around the outer perimeter of a HX tube 205. Rather, an additional aperture 630 is designed to allow for added flow of fluid (e.g., fluid 307) around one or more HX tubes 205 disposed within its outer perimeter 635. In some cases, an additional aperture 630 can be large enough to accommodate an entire perimeter of the HX tube 205, so that the outer perimeter of the HX tube 205 does not physically contact the outer perimeter 635 of the aperture 630. Another example of a baffle is shown below with respect to FIG. 18.

The baffle 270B of FIG. 7 in this case is substantially similar to the tube sheet 210B of FIG. 5. For example, the baffle 270B has a body 715 through which a number of apertures 720 traverse. The body 715 has an outer perimeter 717 that forms, in this case, a circle. The outer perimeter 717 of the baffle 270B has a shape and size the substantially matches the shape and size of the inner surface of the wall 251 toward the middle of the main fluid portion 255A of the thermal transfer device 200. In alternative cases, the outer perimeter 717 of the body 715 of the baffle 270B can have any of a number of other shapes, including but not limited to a square, an oval, a triangle, a hexagon, a random shape, and an octagon.

The baffle 270B can have multiple apertures 720 that traverse the body 715. In such a case, as shown in FIG. 7, all of the apertures 720 can have substantially the same size and shape as each other. Alternatively, the size and shape of one aperture 720 can have a different size and/or shape compared to one or more other apertures 720. Such shapes can include, but are not limited to, a circle (as shown in FIG. 7), a square, an oval, and a triangle. Each of the apertures 720 is configured to receive the middle portion 203 of a HX tube 205.

The body 715 can have a center 713. The apertures 720 that traverse the body 715 of the baffle 270B are disposed in an organized manner around the center 713 of the body 715 of the baffle 270B. For example, in this case, the apertures 720 are organized in five concentric circles around the center 713. The apertures 720 can be arranged in any of a number of other patterns (e.g., rows and columns, randomly) in alternative embodiments. Each aperture 720 has an outer perimeter 725 (which is part of the body 715) that forms, when viewed from above, a circle having a radius and a center 723. Since the HX tubes 205 are linear along their length, the apertures 720 of baffle 270B are vertically aligned with the apertures 620 of baffle 270A (or where the apertures 620 of baffle 270A would be in the absence of apertures 630) when baffle 270B is positioned within the main fluid portion 255A.

Due to the functions served by the baffle 270B, namely to help support at least some of the HX tubes 205 while allowing a controlled amount of fluid (e.g., fluid 307) to pass from one side of the body 715 to the other within the main fluid portion 255A, the shape and size of each aperture 720 is designed to be substantially the same as the shape and size of the tubular outer surface 206 each end 208 of the HX tube 205, even though the middle portion 203 of the HX tube 205 is disposed therein. The example arrangement of a HX tube 205 disposed in an aperture 720 of the baffle 270B can be applied to the example shown in FIG. 10 below, which applies to the arrangement of a HX tube 205 disposed in two apertures 720 of the baffle 270B.

The baffle 270C of FIG. 8 in this case has some similarities to the baffle 270B of FIG. 7, but also many differences, as discussed below. For example, the baffle 270C has a body 815 through which a number of apertures 820, 830, 840 traverse. The body 815 has an outer perimeter 817 that forms, in this case, a circle. The outer perimeter 817 of the baffle 270C has a shape and size the substantially matches the shape and size of the inner surface of the wall 251 toward the top of the main fluid portion 255A of the thermal transfer device 200. In alternative cases, the outer perimeter 817 of the body 815 of the baffle 270C can have any of a number of other shapes, including but not limited to a square, an oval, a triangle, a hexagon, a random shape, and an octagon.

The baffle 270C can have one or more (in this case, only one) apertures 820 that traverse the body 815. In such a case, as shown in FIG. 8, the aperture 820 has a shape (in this case, a circle) and a size (e.g., one inch in diameter). Also in this case, the center 823 of the aperture 820 coincides with the center 813 of the body 815 of the baffle 270C. The outer perimeter 825 of the aperture 820 is part of the body 815. Since this aperture 820 is not vertically aligned with any of the apertures 720 of baffle 270B or the apertures 420 of tube sheet 210A when positioned within the main fluid portion 255A, and since the HX tubes 205 are linear along their length, the aperture 820 of baffle 270C is not vertically aligned with any of the apertures 720 of baffle 270B. As a result, aperture 820 allows for the free flow of fluid (e.g., fluid 307) therethrough during operation of the thermal transfer device 200.

The placement of the one or more apertures 820 in the example baffle 270C has a number of benefits. For example, since there is no HX tube 205 disposed therein, fluid (e.g., fluid 307) flowing through the aperture 820 in the baffle 270C to flow radially across the top surface of the baffle 270C and the bottom surface of the tube sheet 210A. As another example, fluid (e.g., fluid 307) flowing through the aperture 820 can help increase transfer of heat from the HX tubes 205 to the fluid while also reducing the temperature of (thereby reducing the thermal stress on) the baffle 270C. As shown in FIGS. 14 through 17 below, the transition of the outer perimeter 825 of the aperture 820 (or any other aperture described herein, including apertures with protrusions, that traverses the body of an example baffle 270) from the top surface of the body 815 to the bottom surface of the body 815 can have any of a number of configurations.

The baffle 270C of FIG. 8 also includes a number of other apertures, aside from aperture 820, that are vertically aligned with the apertures 720 of baffle 270B and the apertures 420 of tube sheet 210A when baffle 270C is positioned within the main fluid portion 255A. These apertures 830, 840 in the baffle 270C of FIG. 8 have one or more different characteristics (e.g., shapes) relative to the corresponding characteristics of the apertures 720 of baffle 270B and the apertures 420 of tube sheet 210A.

For example, there are multiple apertures 830 that traverse the body 815 of the baffle 270C of FIG. 8. These apertures 830 can have substantially the same size and shape as each other. Alternatively, the size and shape of one aperture 830 can have a different size and/or shape compared to one or more other apertures 830. Such shapes can include, but are not limited to, a circle with three smaller semi-circular protrusions 837 extending therefrom (as shown in FIG. 8), a square (with or without protrusions), an oval (with or without protrusions), and a triangle (with or without protrusions). Each aperture 830 has a center 833 relative to its core shape (in this case, a circle). Since the distance 259 between baffle 270C and tube sheet 210A is relatively small (e.g., three inches), each of the apertures 830 is configured to receive the end 208, as opposed to the middle portion 203, of a HX tube 205.

Figure 12:
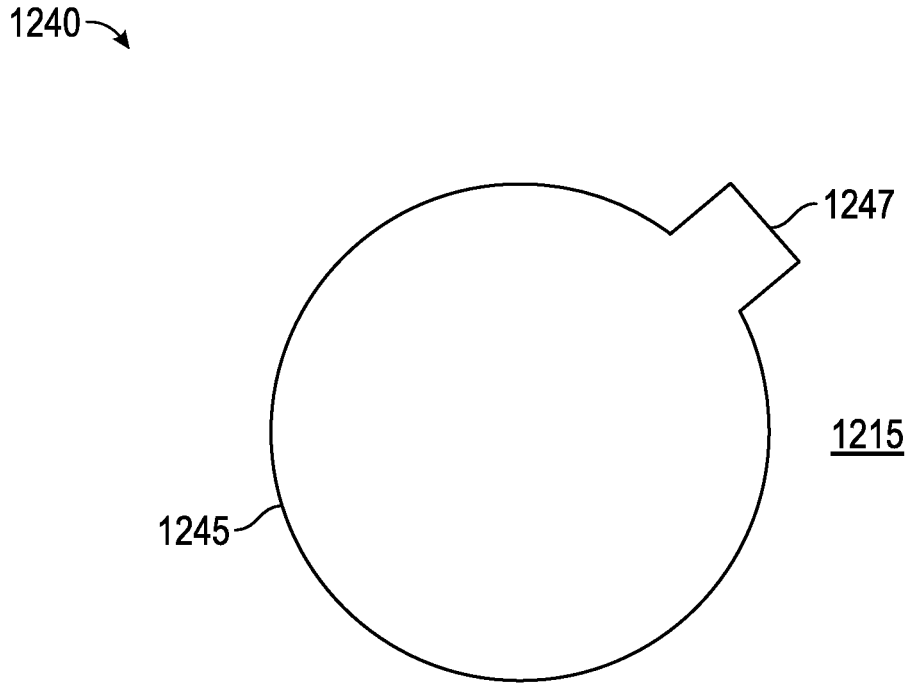
FIGS. 12 and 13 show various protruding features in accordance with certain example embodiments.
Figure 13:
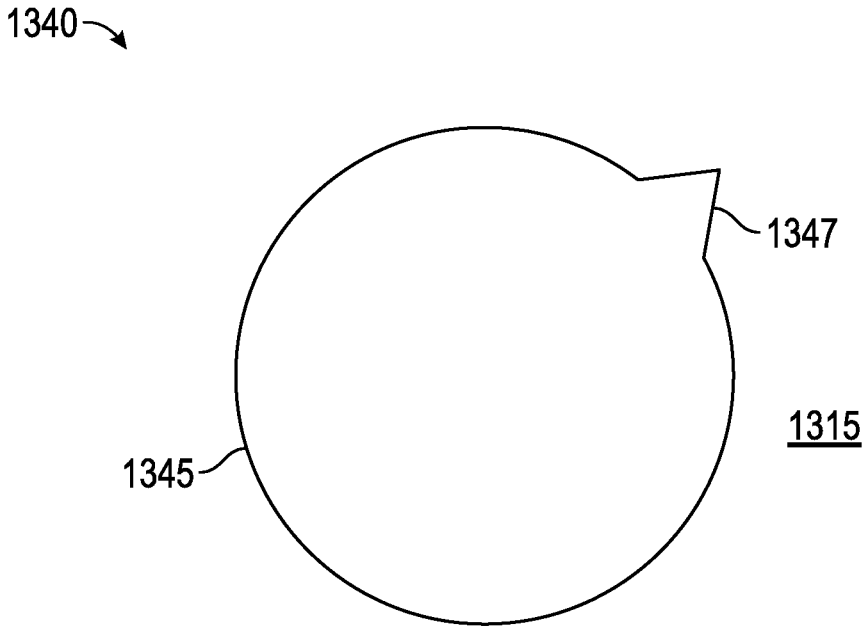
Figure 14:
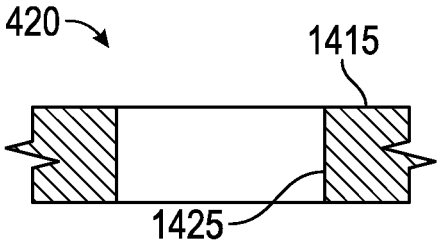
FIGS. 14 through 17 show cross-sectional side views of various apertures in accordance with certain example embodiments.

As discussed above, each of the apertures 830 has one or more protrusions 837 that extend outward from a base shape (in this case, a circle) that forms the outer perimeter 835 of the aperture 830. Put another way, the outer perimeter 835 of each of the apertures 830 can be defined by an overlap of the base circle shape with three smaller circles whose center is approximately located along the outer perimeter of the base circle. The three protrusions 837 in this case are semi-circles, where one protrusion 837 extends toward the outer perimeter 817, and the other 2 protrusions 837 are located approximately 90° on either side of the protrusion directed toward the outer perimeter 817. The number of protrusions 837, the arrangement of protrusions 837, the shape of each protrusion 837, the size of each protrusion 837, and/or any other characteristic of a protrusion 837 can vary relative to what is shown in FIG. 8. For example, FIGS. 12 and 13 below show apertures with various shapes of a protrusion 837 of an aperture 830.

Figure 11:
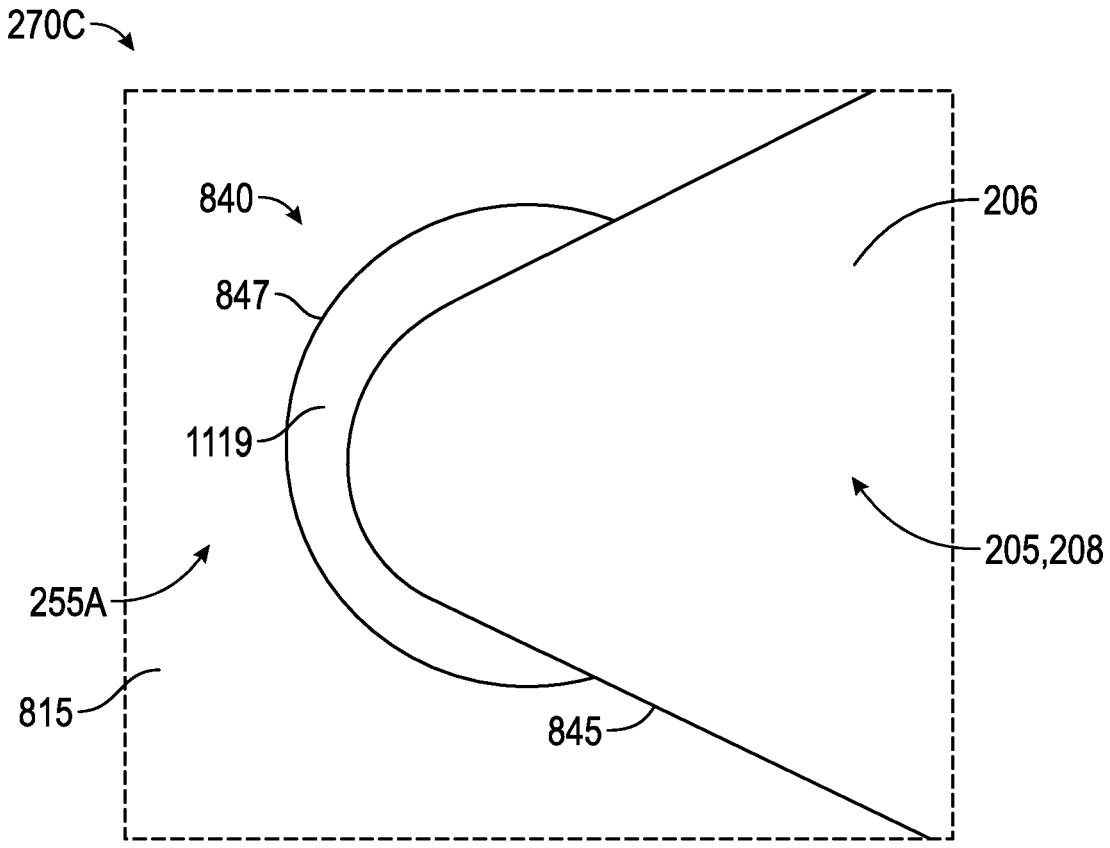
FIG. 11 shows a detailed cross-sectional top view of the interaction between a HX tube and another baffle of FIGS. 2A through 2D in accordance with certain example embodiments.

As shown in FIG. 11 below, each of the protrusions 837 allow for the flow of fluid (e.g., fluid 307) therethrough. The apertures 830 in this case are arranged in three concentric circles, starting closest to the outer perimeter 817 of the baffle 270C and working inward toward the center 813 of the baffle 270C. The number and location of the apertures 830 in the baffle 270C vertically align with the three outer-most circles of apertures 720 of baffle 270B and the three outer-most circles of apertures 420 of tube sheet 210A when baffle 270C is positioned within the main fluid portion 255A.

There are also multiple apertures 840 that traverse the body 815 of the baffle 270C of FIG. 8. These apertures 840 can have substantially the same size and shape as each other. Alternatively, the size and shape of one aperture 840 can have a different size and/or shape compared to one or more other apertures 840. Such shapes can include, but are not limited to, a circle with a single smaller semi-circular protrusion 847 extending therefrom (as shown in FIG. 8), a square (with or without protrusions), an oval (with or without protrusions), and a triangle (with or without protrusions). Each aperture 840 has a center 843 relative to its core shape (in this case, a circle). Since the distance 259 between baffle 270C and tube sheet 210A is relatively small (e.g., three inches), each of the apertures 840 is configured to receive the end 208, as opposed to the middle portion 203, of a HX tube 205.

As discussed above, each of the apertures 840 shown in FIG. 8 has a single protrusion 847, but in alternative embodiments one or more of the apertures 840 can have multiple protrusions 847. The protrusion 847 in this case extends outward from a basic shape (in this case, a circle) that forms the outer perimeter 845 of the aperture 840. This protrusion 847 in this case is a semi-circle, substantially identical to the shape and size of the protrusions 837 of the apertures 830, where the protrusion 847 extends toward the outer perimeter 817 of the baffle 270C. The number of protrusions 847, the location and/or arrangement of the one or more protrusions 847, the shape of each protrusion 847, the size of each protrusion 847, and/or any other characteristic of a protrusion 847 can vary relative to what is shown in FIG. 8. The example shapes of a protrusion 837 for an aperture 830 shown in FIGS. 12 and 13 (as well as any of a number of other shapes) can apply equally to a protrusion 847 of an aperture 840.

Similarly, as shown in FIG. 11 below, each of the protrusions 847 allow for the flow of fluid (e.g., fluid 307) therethrough. The apertures 840 in this case are arranged in two concentric circles, starting next to aperture 820 located in the center 813 and working outward toward the outer perimeter 817 of the baffle 270C. The number and location of the apertures 840 in the baffle 270C vertically align with the two innermost circles of apertures 720 of baffle 270B and the two inner-most circles of apertures 420 of tube sheet 210A when baffle 270C is positioned within the main fluid portion 255A.

The body 815 of baffle 270C can have a center 813. As discussed above, the apertures 820, 830, 840 that traverse the body 815 of the baffle 270C can be disposed in an organized manner around the center 813 of the body 815 of the baffle 270C. For example, in this case, aperture 820 is placed in the center 813, the apertures 840 are organized in two concentric circles around the center 813 outwardly adjacent to aperture 820, and the apertures 830 are organized in three concentric circles outwardly adjacent to the apertures 840. The apertures 820, 830, 840 can be arranged in any of a number of other patterns (e.g., rows and columns, randomly) in alternative embodiments.

Due to the functions served by the baffle 270C, namely to help support at least some of the HX tubes 205 while allowing a controlled amount of fluid (e.g., fluid 307) to pass from one side of the body 815 to the other within the main fluid portion 255A, the shape and size of each aperture 830, 840 is designed to be substantially the same as the shape and size of the outer surface of an end 208 of an HX tube 205 disposed therein.

FIG. 9 shows a detailed cross-sectional top view of the interaction between a HX tube 205 and part of the tube sheet 210A of FIGS. 2A through 2D. Referring to FIGS. 1A through 9, the tubular outer surface 206 at one end 208 of the HX tube 205 is disposed within an aperture 420 that traverses the body 415 of the tube sheet 210A. The outer surface 425 of the aperture 420 has a circular shape with a radius that is substantially the same as the circular shape and radius of the tubular outer surface 206 of the HX tube 205. In this way, there is seal that is formed so that no fluid (e.g., fluid 307) can pass from one side of the tube sheet 210A through the joint formed at the aperture 420. In some cases, the seal can be reinforced directly (e.g., using mating threads) or indirectly (e.g., a weld). Inside of the HX tube 205 is a continuous path within the cavity 265B along the entire length of the HX tube 205. As discussed above, a combusted fuel/air mixture (e.g., combusted fuel/air mixture 309) flows through the cavity 265B.

Figure 10:
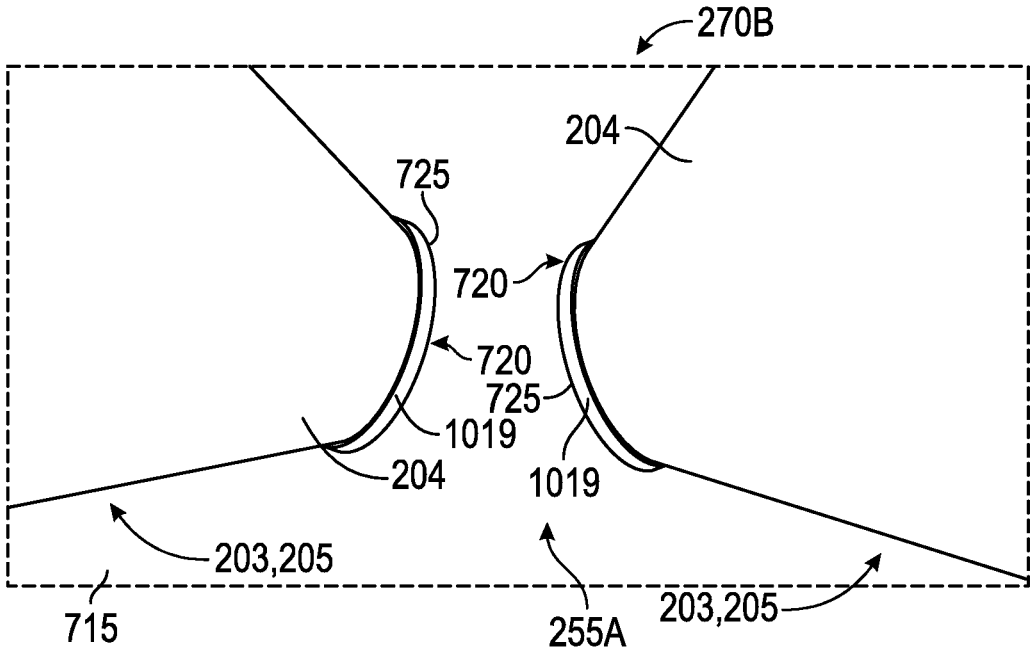
FIG. 10 shows a detailed cross-sectional top view of the interaction between a HX tube and a baffle of FIGS. 2A through 2D in accordance with certain example embodiments.

FIG. 10 shows a detailed cross-sectional top view of the interaction between two HX tubes 205 and the baffle 270B of FIGS. 2A through 2D in accordance with certain example embodiments. Referring to FIGS. 1A through 10, the middle portion 203 of each HX tube 205 is disposed within an aperture 720 that traverses the body 715 of the tube sheet 210A. The outer surface 725 of each aperture 720 has a radius that is substantially the same as the radius of the tubular outer surface 206 of each HX tube 205. However, since the middle portion 203 of each HX tube 205 is disposed in an aperture 720, there is a gap 1019 between at least a portion of the outer perimeter 204 of the middle portion 203 of the HX tubes 205 and the outer perimeter 725 of the apertures 720. Fluid (e.g., fluid 307) can flow through these gaps 1019.

FIG. 11 shows a detailed cross-sectional top view of the interaction between a HX tube 205 and the baffle 270C of FIGS. 2A through 2D in accordance with certain example embodiments. Referring to FIGS. 1A through 11, the tubular outer surface 206 at one end 208 of the HX tube 205 is disposed within an aperture 840 that traverses the body 815 of the baffle 270C. The outer surface 845 of the aperture 840 has a circular shape (disregarding the protrusion 847) with a radius that is substantially the same as the circular shape and radius of the tubular outer surface 206 of the HX tube 205. In this way, there can be a seal that is formed between the outer perimeter 845 (not including the protrusion 847) and the outer surface 206 side of the tube sheet 210A. In some cases, the seal can be reinforced directly (e.g., using mating threads) or indirectly (e.g., a weld). As for the portion of the aperture 840 that includes the protrusion 847, a gap 1119 is formed between the outer perimeter of the protrusion 847 and tubular outer surface 206 of the HX tube 205. Fluid (e.g., fluid 307) can flow through this gap 1119.

Figure 15:
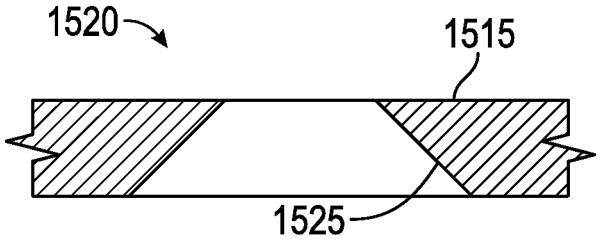

FIGS. 14 through 17 show cross-sectional side views of various apertures in accordance with certain example embodiments. Referring to FIGS. 1A through 17, FIG. 14 shows a cross-sectional side view of an aperture 1420 that traverses the body 1415 of an example baffle (e.g., baffle 270C), where the outer perimeter 1425 is a wall that is substantially perpendicular to the top surface and the bottom surface of the body 1415 of the baffle. FIG. 15 shows a cross-sectional side view of an aperture 1520 that traverses the body 1515 of an example baffle (e.g., baffle 270C), where the outer perimeter 1525 is a wall that is slanted away from the top surface toward the bottom surface of the body 1515 of the baffle, so that the size (in this case, a diameter) of the aperture 1520 is larger at the bottom than it is at the top.

Figure 16:
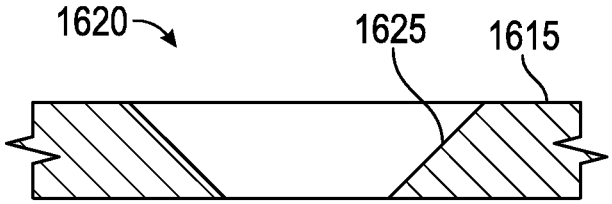
Figure 17:
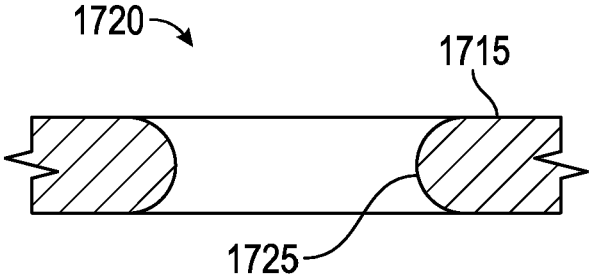

FIG. 16 shows a cross-sectional side view of an aperture 1620 that traverses the body 1615 of an example baffle (e.g., baffle 270C), where the outer perimeter 1625 is a wall that is slanted away from the bottom surface toward the top surface of the body 1615 of the baffle, so that the size (in this case, a diameter) of the aperture 1620 is larger at the top than it is at the bottom. FIG. 17 shows a cross-sectional side view of an aperture 1720 that traverses the body 1715 of an example baffle (e.g., baffle 270C), where the outer perimeter 1725 is a wall that forms an outwardly-facing (into the aperture 1720) semicircle between the top surface and the bottom surface of the body 1715 of the baffle.

Figure 18:
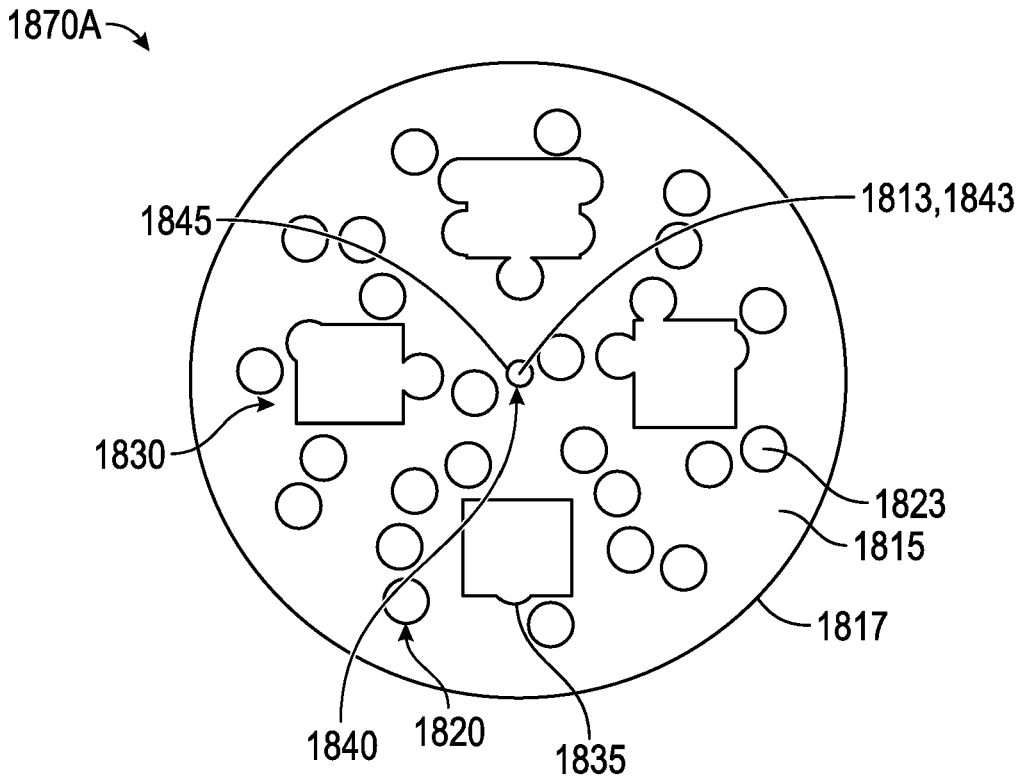
FIG. 18 shows another baffle in accordance with certain example embodiments.

FIG. 18 shows a top view of another baffle 1870A in accordance with certain example embodiments. Referring to FIGS. 1A through 18, the baffle 1870A of FIG. 18 is substantially the same as the baffle 270A of FIG. 6, except as described below. For example, the baffle 1870A of FIG. 18 has a body 1815 through which a number of apertures 1820 traverse. The body 1815 has an outer perimeter 1817 that forms, in this case, a circle. The outer perimeter 1817 of the baffle 1870A has a shape and size the substantially matches the shape and size of the inner surface of the wall 251 toward the bottom of the thermal transfer device 200 of FIGS. 2A through 3B. In alternative cases, the outer perimeter 1817 of the body 1815 of the baffle 1870A can have any of a number of other shapes, including but not limited to a square, an oval, a triangle, a hexagon, a random shape, and an octagon.

The baffle 1870A can have multiple apertures 1820 that traverse the body 1815. In such a case, as shown in FIG. 18, all of the apertures 1820 can have substantially the same size and shape as each other. Alternatively, the size and shape of one aperture 1820 can have a different size and/or shape compared to one or more other apertures 1820. Such shapes can include, but are not limited to, a circle (as shown in FIG. 18), a square, an oval, and a triangle. Each of the apertures 1820 is configured to receive the bottom end of a HX tube (e.g., HX tube 205).

The body 1815 can have a center 1813, which coincides with the center 1843 of another aperture 1840, also in the shape of a circle (but being able to have any of a number of other shapes) defined by an outer perimeter 1845. In this case, the size (e.g., diameter) of aperture 1840 is smaller than the size of the apertures 1820. The apertures 1820 that traverse the body 1815 of the baffle 1870A are disposed in an organized manner around the center 1813 of the body 1815 of the baffle 1870A. For example, in this case, the apertures 1820 are organized in five concentric circles around the center 1813, matching the configuration of the apertures 420 of the tube sheet 210A of FIG. 4 and the apertures 520 of the tube sheet 210B of FIG. 5. However, since there is no aperture in the tube sheet 210 of FIG. 4 and in the tube sheet 210B of FIG. 5, fluid (e.g., fluid 307) is free to flow through aperture 1840 in the baffle 1870A of FIG. 18.

The apertures 1820 can be arranged in any of a number of other patterns (e.g., rows and columns, randomly) in alternative embodiments. Each aperture 1820 has an outer perimeter 1825 (which is part of the body 1815) that forms, when viewed from above, a circle having a diameter. Since the HX tubes (e.g., HX tubes 205) are linear along their length, the apertures 1820 of baffle 1870A (or where the apertures 1820 would be in the absence of apertures 1830) are vertically aligned with the apertures 520 of tube sheet 210B when baffle 270A is positioned within the main fluid portion 255A.

Due to the functions served by the baffle 1870A, namely to help support at least some of the HX tubes (e.g., HX tubes 205) while allowing a controlled amount of fluid (e.g., fluid 307) to pass from one side of the body 1815 to the other within the main fluid portion 255A, the shape and size of each aperture 1820 is designed to be substantially the same as the shape and size of the tubular outer surface 1806 at each end 208 of the HX tube 205, even though the middle portion 203 of the HX tube 205 is disposed therein.

As for the apertures 1830 of the baffle 1870A, HX tubes 205 that are disposed therein have an increased amount of fluid (e.g., fluid 307) flowing around their outer surface because the outer perimeter 1835 of each aperture 1830 either does not come into contact with the outer surface of a HX tube 205 or contacts only a portion (circumferentially) of the outer surface of a HX tube 205.

In certain example embodiments, such as what is shown in FIG. 18, one or more of the baffles (in this case, baffle 1870A) can have one or more additional apertures 1830, of a different shape relative to apertures 1820 and aperture 1840, traversing through the body 1815. These one or more additional apertures 1830 can be larger (as in this case) or smaller than the apertures 1820. If there are multiple additional apertures 1830, one additional aperture 1830 can have the same and/or different characteristics (e.g., shape (e.g., square, rectangle, wedge, arc segment), size, location relative to the center 1813) relative to one or more of the other additional apertures 1830. In this case, there are four identical additional apertures 1830 that have the shape of a square with a height that is approximately equal to the diameter of two apertures 1820. The four apertures 1830 of FIG. 18 are spaced equidistantly from each other and evenly distributed around the center 1813. Specifically, one aperture 1830 is located in an approximate 3:00 position, a second aperture 1830 is located in an approximate 6:00 position, a third aperture 1830 is located in an approximate 9:00 position, and the fourth aperture 1830 is located in an approximate 12:00 position.

One or more of the additional apertures 1830 can be positioned independently of any of the apertures 1820. Alternatively, as in this case, one or more of the additional apertures 1830 can be superimposed with respect to one or more of the apertures 1820. In such a case, when an aperture 1820 partially overlaps with an aperture 1830, the outer perimeter 1835 of the aperture 1830 is distorted (extended) at that location. These additional apertures 1830 are not configured, like apertures 1820, to fit around the outer perimeter of a HX tube 205. Rather, an additional aperture 1830 is designed to allow for added flow of fluid (e.g., fluid 307) around one or more HX tubes 205 disposed within its outer perimeter 1835. In some cases, an additional aperture 1830 can be large enough to accommodate an entire perimeter of the HX tube 205, so that the outer perimeter of the HX tube 205 does not physically contact the outer perimeter 1835 of the aperture 1830.

Example embodiments described herein allow for flexible and more efficient designs for thermal transfer devices (e.g., condensing boilers, heat exchangers, water heaters) in which example baffles can be used. Example embodiments can be used to improve the flow of fluid through thermal transfer devices where such fluids absorb thermal energy (e.g., heat, cold) for use in another process. Example embodiments can also be used to help ensure that these fluids are physically separated from the fuel (often in combusted form and mixed with air) used to drive the transfer of the thermal energy. Example embodiments can be customizable with respect to any of a number of characteristics (e.g., shape, size, aperture configuration, aperture location, protrusions). Further, the shape, size, and other characteristics of an example baffle can be specifically configured for a particular thermal transfer device. Example embodiments can be mass produced or made as a custom order.

Some thermal transfer devices can include multiple example baffles that are configured differently (e.g., location, size, and/or number of smaller apertures, location, size, and/or number of larger apertures) relative to each other. Such configurations can increase thermal efficiency relative to the current art. Further, such configurations of baffles can significantly lower the metal or tube temperature at targeted locations of the thermal transfer device. Further, the number of example baffles and the location of the baffles relative to each other are novel features in the art that promote increased thermal efficiency, increased mechanical stability, improved fluid and hot gas flow, and increased durability over the current art.

The various configurations, including aperture size, number of apertures, symmetric/asymmetric baffle designs, and single/multiple relatively larger aperture variations, of example baffles described herein can help make the flow pattern of the fluid in the thermal transfer device more uniform. Such configurations of the example baffles also reduce the temperature of the HX tubes, walls, baffles, tube sheets, and other materials within the thermal transfer device, thereby increasing the durability of the thermal transfer device. Example embodiments can also be used in environments that require compliance with one or more standards and/or regulations.

Accordingly, many modifications and other embodiments set forth herein will come to mind to one skilled in the art to which example baffles pertain having the benefit of the teachings presented in the foregoing descriptions and the associated drawings. Therefore, it is to be understood that baffles are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A baffle for a thermal transfer device, the baffle comprising:

a plate having a plurality of first apertures extending therethrough, each of the plurality of first apertures (i) has a first shape that includes a generally circular base shape and a notch shape extending from an outer edge of the generally circular base shape and (ii) being configured to receive a corresponding tube of a plurality of tubes, wherein each of the plurality of first apertures is configured to receive a tube of a plurality of tubes, each tube having a generally circular shape such that the notch shape forms a gap through which a fluid can flow from a first side surface of the baffle to a second side surface of the baffle, wherein the plate is configured to attach to one or more internal sidewalls of the thermal transfer device such that the plate is disposed at a non-perpendicular angle with respect to the one or more internal sidewalls of the thermal transfer device.

2. The baffle of claim 1, wherein at least a portion of the plate is curved.

3. The baffle of claim 1, wherein the plate has a generally ovular shape.

4. The baffle of claim 1 further comprising a second aperture extending therethrough, the second aperture being configured to form a gap through which the fluid can flow from the first side surface of the baffle to the second side surface of the baffle.

5. The baffle of claim 4, wherein the second aperture has a second shape that is different from the first shape.

6. The baffle of claim 4, wherein the second shape has an area that is greater than an area of the first shape.

7. The baffle of claim 4, wherein the second aperture intersects at least two of the plurality of first apertures.

8. The baffle of claim 4, wherein the second aperture is located independently of the plurality of first apertures.

9. The baffle of claim 1, wherein the plurality of first apertures are asymmetrically arranged about the plate.

10. An assembly for a thermal transfer device, wherein the assembly comprises:

a first plate comprising a plurality of first apertures extending therethrough, the plurality of first apertures being arranged in a first arrangement and each of the plurality of first apertures being configured to receive a corresponding tube of a plurality of tubes;

a second plate comprising a second plurality of second apertures extending therethrough, the second plurality of second apertures being arranged in the first arrangement and each of the plurality of second apertures being configured to receive a corresponding tube of the plurality of tubes; and a third plate disposed between the first and second plates, the third plate comprising a plurality of third apertures extending therethrough, each of the plurality of third apertures (i) being configured to receive a corresponding tube of the plurality of tubes and (ii) having a first shape that includes a generally circular base shape and a notch shape extending from an outer edge of the generally circular base shape, each notch shape being configured to form a gap when the corresponding second aperture receives the corresponding tube such that a fluid can flow through the gap from a first side surface of the third plate to a second side surface of the third plate, wherein the first, second, and third plates are configured to maintain each of the plurality of tubes in a generally vertical orientation.

11. The assembly of claim 10, wherein at least one of the first, second, and third plates has an outer body shape that is substantially the same as an inner perimeter shape of one or more internal walls of the thermal transfer device.

12. The assembly of claim 10, wherein a first distance between the first and third plates is different from a second distance between the second and third plates.

13. The assembly of claim 10, wherein at least one of the first, second, or third plates is configured to attach to one or more internal walls of the thermal transfer device such that the at least one of the first, second, or third plates is disposed at a non-perpendicular angle with respect to the one or more internal walls of the thermal transfer device.

14. The assembly of claim 13, wherein at least one of the first, second, or third plates has a generally ovular shape.

15. The assembly of claim 10, wherein at least a portion of at least one of the first, second, or third plates is curved.

16. The assembly of claim 10, wherein the third plate further comprises a fourth aperture extending therethrough, the fourth aperture being configured to form a gap through which the fluid can flow from the first side surface of the third plate to the second side surface of the third plate.

17. The assembly of claim 16, wherein the fourth aperture intersects at least two of the plurality of second apertures.

18. The assembly of claim 10, wherein at least two of the first, second, and third plates are tube sheets.

19. The assembly of claim 10, wherein at least two of the first, second, and third plates are baffles located between two tube sheets.

* * * * *